US005966113A

United States Patent [19]

Hidaka et al.

[11] Patent Number: 5,966,113

[45] **Date of Patent: *Oct. 12, 1999**

[54] RECEIVING TERMINAL WITH A MESSAGE DISPLAY FUNCTION

[75] Inventors: Shinji Hidaka, Ome; Yoichi Aoki, Ichikawa; Manabu Doi, Hamura, all of Japan

[73] Assignee: Casio Computer Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/552,013

[22] Filed: Nov. 2, 1995

[30] Foreign Application Priority Data

Nov. 11, 1994 [JP] Japan ..... 6-303194
Sep. 7, 1995 [JP] Japan ..... 7-257072

[51] Int. Cl.[6] ..... G09G 5/00

[52] U.S. Cl. ..... 345/112; 340/825.44

[58] Field of Search ..... 345/112, 115, 345/141, 185, 201, 203, 192, 193, 3, 168, 169; 340/825.44

[56] References Cited

U.S. PATENT DOCUMENTS

| | | | |
|---|---|---|---|
| 4,952,927 | 8/1990 | DeLuca et al. | 340/825.44 |
| 5,493,602 | 2/1996 | Shibayma | 340/825.44 |
| 5,561,702 | 10/1996 | Lipp et al. | 340/825.44 |

FOREIGN PATENT DOCUMENTS

| | | |
|---|---|---|
| 0218936 A3 | 4/1987 | European Pat. Off. . |
| WO 82/02975 | 9/1982 | WIPO . |

*Primary Examiner*—Xiao Wu
*Attorney, Agent, or Firm*—Frishauf, Holtz, Goodman, Langer & Chick, P.C.

[57] ABSTRACT

A pager comprises a receiving section for receiving message data, an LCD for displaying the message based on the message data, and a memory for storing the format No. contained in the format code specifying the display format of the message and the actually displayed display format in such a manner that they correspond to each other. When a format code is sensed from the received message data, a display format is read from the memory according to the format No. contained in the format code and develops the subsequence display data on the display format, thereby displaying it on the LCD.

19 Claims, 27 Drawing Sheets

FIG.3

10

| FORMAT No. | DISPLAY FORMAT |
|---|---|
| | |
| | |
| | |
| ⋮ | ⋮ |

FIG.4A

No. 05

STOCK PRICE INFORMATION

No : ---------- ---------- ---------- YEN
--------- YEN
No : ---------- ---------- ---------- YEN
--------- YEN
No : ---------- ---------- ---------- YEN
--------- YEN

FIG.4B

No. 10

INVENTORY INFORMATION

| NAME OF ARTICLE | No. OF SHIPMENT | No. OF SUPPLIES | No. OF STOCKS |
|---|---|---|---|
| ---------- | --------- | --------- | --------- |
| ---------- | --------- | --------- | --------- |
| ---------- | --------- | --------- | --------- |
| ---------- | --------- | --------- | --------- |
| ---------- | --------- | --------- | --------- |

FIG.4C

No. 30

SCHEDULE

--- MONTH --- DAY --- HOUR --- MINUTE

---
---
---
---
---

FIG.10

| CONTENTS OF AUTOMATIC SETTING | FLAG |
|---|---|
| AREA SELECTION | |
| DATA REARRANGEMENT | |

211

FIG.11

| | 1 | 2 | 3 | 4 | 5 | 6 | 7 | 8 | 9 | 0 |
|---|---|---|---|---|---|---|---|---|---|---|
| 1 | ア | イ | ウ | エ | オ | A | B | C | D | E |
| 2 | カ | キ | ク | ケ | コ | F | G | H | I | J |
| 3 | サ | シ | ス | セ | ソ | K | L | M | N | O |
| 4 | タ | チ | ツ | テ | ト | P | Q | R | S | T |
| 5 | ナ | ニ | ヌ | ネ | ノ | U | V | W | X | Y |
| 6 | ハ | ヒ | フ | ヘ | ホ | Z | ; | ' | ? | • |
| 7 | マ | ミ | ム | メ | モ | ァ | ィ | ゥ | ェ | ォ |
| 8 | ヤ | ( | ユ | ) | ヨ | ゃ | ゅ | ょ | - | . |
| 9 | ラ | リ | ル | レ | ロ | 1 | 2 | 3 | 4 | 5 |
| 0 | ワ | ヲ | ン | . | . | 6 | 7 | 8 | 9 | 0 |

FIG.12

| JOB CONTENT | MESSAGE TITLE | ITEM TITLE |
|---|---|---|
| PLEASE CALL ME | PLEASE CONTACT | ADDRESS, ADDRESSER'S NAME, INCOMING TIME, COMMENT |
| MEETING | COME TO THE FOLLOWING PLACE | INCOMING TIME, MEETING TIME, MEETING PLACE, NAME |
| BUSINESS | PLEASE | CLIANT'S NAME, WORK PLACE, JOB, DEADLINE |
| URGENCY | URGENT MATTER | NAME, ADDRESEE, COMMENT, PLACE |
| ASSEMBLY | PLEASE ASSEMBLE ON THE FOLLOWING PLACE | ASSEMBLY TIME, ASSEMBLY PLACE, LEADER, CONTENTS |

FIG.14

| ITEM CODE | KIND OF ITEM | DATA DISTINCTION FLAG |
|---|---|---|
| *1 | NAME | 0 |
| *2 | PLACE | 0 |
| *3 | TELEPHONE NO. | 0 |
| *4 | TIME | 1 |
| *5 | ADDRESS | 0 |
| *6 | INCOMING TIME | 1 |
| *7 | OTHERS | 0 |
| ⋮ | ⋮ | ⋮ |

ED

FIG.15

| JOB CODE | JOB CONTENT | DISPLAY FORMAT | | | | PRIORITY ITEM CODE |
|---|---|---|---|---|---|---|
| | | LINE | ITEM TITLE | ITEM CODE | KIND OF ITEM | |
| *01 | PLEASE CALL ME | 2 | ADDRESSEE | *3 | TELEPHONE | *6 |
| | | 3 | ADDRESSER'S NAME | *2 | NAME | |
| | | 4 | INCOMING TIME | *6 | INCOMING TIME | |
| | | 5 | COMMENT | *7 | OTHERS | |
| *02 | MEETING | 2 | INCOMING TIME | *6 | INCOMING TIME | *4 |
| | | 3 | MEETING TIME | *4 | TIME | |
| | | 4 | MEETING PLACE | *2 | PLACE | |
| | | 5 | NAME | *1 | NAME | |
| *03 | BUSINESS | 2 | CLIENT'S NAME | *1 | NAME | *2 |
| | | 3 | WORK PLACE | *2 | PLACE | |
| | | 4 | JOB | *7 | OTHERS | |
| | | 5 | | | | |
| *04 | OTHERS | | | | | |

FIG.16

| NAME (*1) | TELEPHONE NO. (*3) | ADDRESS (*5) | PRIORITY |
|---|---|---|---|
| AOKI YOUICHI | 0111-22-3333 | ADDRESS 1 | 2 |
| SUGIO NAOTO | 0123-45-6789 | ADDRESS 2 | 3 |
| TAKAHASHI OU | 0987-65-1321 | ADDRESS 3 | 1 |
| | | | |
| | | | |

TB

| | KEYWORD | PRIORITY |
|---|---|---|
| KIND OF ITEM = PLACE | TOKYO | 1 |
| | OSAKA | 2 |
| | NAGOYA | 3 |
| | SHINJYUKU | 4 |
| | NAKANO | 5 |

PD

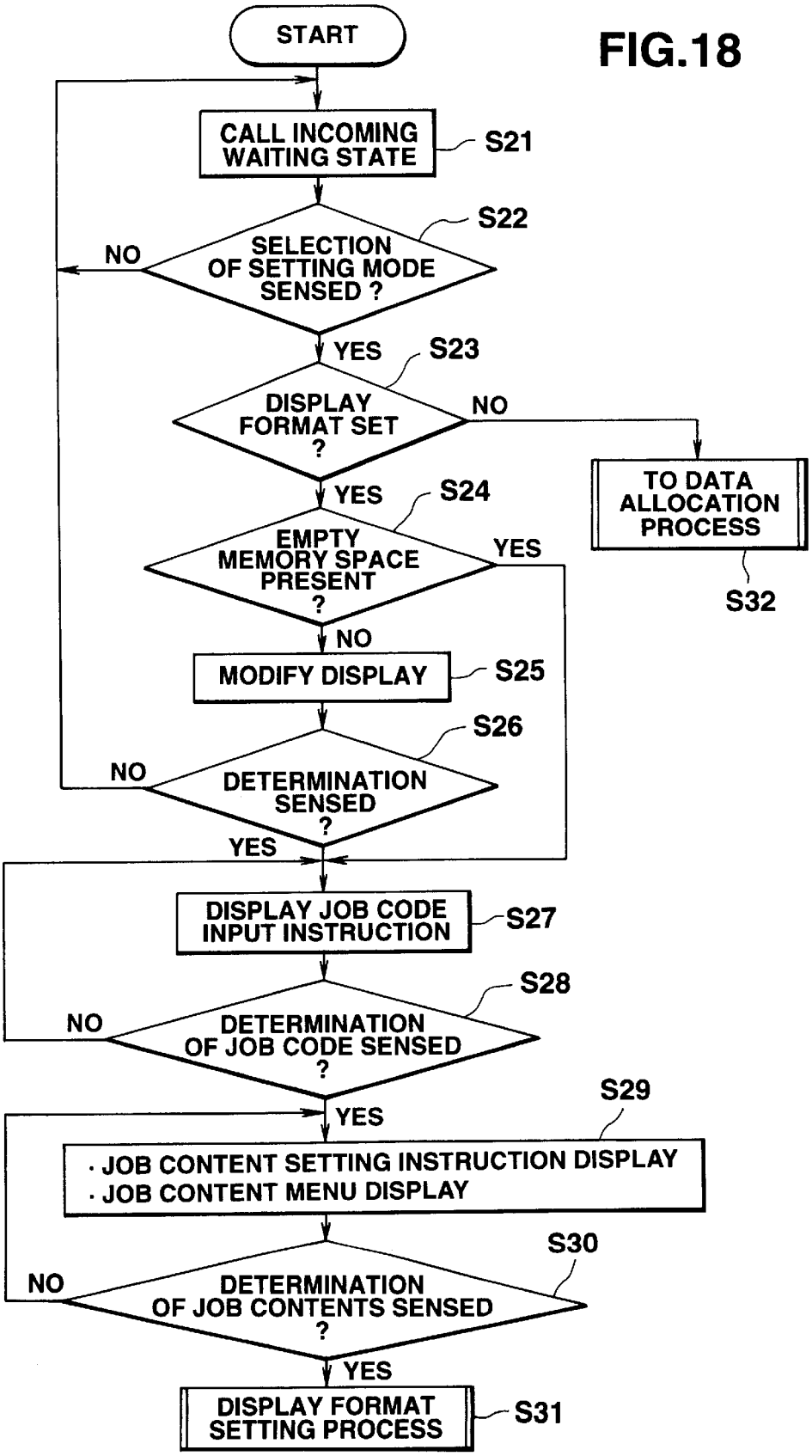
FIG.18
START
CALL INCOMING WAITING STATE
S21
SELECTION OF SETTING MODE SENSED ?
S22
NO
YES
DISPLAY FORMAT SET ?
S23
NO
TO DATA ALLOCATION PROCESS
S32
YES
EMPTY MEMORY SPACE PRESENT ?
S24
YES
NO
MODIFY DISPLAY
S25
DETERMINATION SENSED ?
S26
NO
YES
DISPLAY JOB CODE INPUT INSTRUCTION
S27
DETERMINATION OF JOB CODE SENSED ?
S28
NO
YES
· JOB CONTENT SETTING INSTRUCTION DISPLAY
· JOB CONTENT MENU DISPLAY
S29
DETERMINATION OF JOB CONTENTS SENSED ?
S30
NO
YES
DISPLAY FORMAT SETTING PROCESS
S31

FIG.24

15

PLEASE COME TO THE FOLLOWING PLACE

INCOMING TIME : *6
MEETING TIME : *4
MEETING PLACE : *2
NAME : *1
SETTING END Yes / No

FIG.25

15

PRIORITY SETTING

INCOMING TIME : *6
MEETING TIME : *4
MEETING PLACE : *2
NAME : *1
SETTING END Yes / No

FIG.26

15

DATA ALLOCATION SETTING f { AREA SELECTION : ( AUTO NAMU )
DATA REARRANGEMENT : ( AUTO NAMU )

SETTING END Yes / No

FIG.28

| ADDRESS | MESSAGE DATA | MEETING TIME |
|---|---|---|
| 1 | MESSAGE 1 | 9 : 30 |
| 2 | MESSAGE 2 | 10 : 40 |
| 3 | MESSAGE 3 | 13 : 00 |
| 4 | THE PRESENT MESSAGE | 13 : 10 |
| 5 | MESSAGE 4 | 14 : 50 |
| 6 | MESSAGE 5 | 17 : 30 |
| ⋮ | ⋮ | ⋮ |

RECEIVING TERMINAL WITH A MESSAGE DISPLAY FUNCTION

BACKGROUND OF THE INVENTION

1. Field of the Invention

This invention relates to a receiving terminal most suitable for paging receivers, and more particularly to a receiving terminal having a display function that develops and displays the incoming data in a fixed format and a memory function that sorts out and stores the incoming data.

2. Description of the Related Art

Since pagers can be used at lower rates than automobile telephones and portable telephones, not only do more and more companies have their salespersons carry pagers with them to contact their companies by phone from where they have gone, but also an increasing number of individuals use pagers as handy tools for communicating with their friends who are out. For individuals, there are telephones as means for accessing conventional pagers. In the case of companies and individual informers, operation service companies, personal computers, information processing companies, etc. function to access conventional pagers.

With those pagers, the informer notifies the called party that he wants to be contacted by telephone, by using the call signal of the relevant pager stored in a pager service company to sound an alarm, turn on the indicator, or vibrate, or by receiving the message added to the call signal and indicating the phone number or name of the calling party.

Some of those pagers have a memory function that sorts out the incoming data by the address data specified by the call signal and stores the sorted data.

With such conventional pagers, however, in the call incoming process, the character data based on the incoming data is developed directly on the display section, which thereby displays it. When the data with a specific display format for information service is received and displayed, all of the display content data including the blank data not to be displayed is taken in. This therefore causes the problem that it takes a longer time to complete the call incoming process and more memory is needed.

In the case of a pager with the function of memorizing a plurality of address data items about the call signal, sorting out the incoming data by address, and storing the sorted data, since the incoming data is mainly used only for individual management of the information service corresponding to the incoming address data, this causes the problem that the message memory cannot be used effectively in the case of normal messages other than those of the information service.

The aim of the present invention is to provide a receiving terminal which not only enables the reduction of the amount of transmitted data in displaying the data in a fixed display format, but also makes effective use of the message memory by sorting out and storing the incoming data.

SUMMARY OF THE INVENTION

An object of the present invention is to provide a receiving terminal which enables not only the display of a message in a fixed display format, but also the sorting out and storing of the incoming data into the memory area corresponding to the display format, just by receiving only the display format specifying data that specifies a fixed display format and the display content data about the actually displayed portion.

Another object of the present invention is to provide a receiving terminal capable of adding and changing display formats easily.

The foregoing objects can be accomplished by providing a receiving terminal comprising: receiving means for receiving data; display means for displaying the received data; display format storage means for storing a display format of the received data on the display means and a format code specifying the display format in such a manner that they correspond to each other; sensing means for sensing the format code from the received data; and control means for controlling the storage means so as to read the display format corresponding to the format code from the display format storage means when the sensing means senses the format code from the received data and then to display the received data in the display format on the display means.

The foregoing objects are also accomplished by providing a receiving terminal comprising: receiving means for receiving data; storage means for storing the received data in a specific order; order storage means for storing the order in which the received data is stored and order specify data in such a manner that they correspond to each other; order specify data sensing means for sensing the order specify data from the received data; and storing means for reading the corresponding order from the order storage means and storing the received data in the storage means in the specified order, when the order specify data sensing means senses the order specify data.

The foregoing objects are still further accomplished by providing a receiving terminal comprising: a receiving circuit for receiving data; a display for displaying the received data; a memory for storing a display format of the received data on the display and a format code specifying the display format in such a manner that they correspond to each other; and a CPU for controlling the memory so as to read the display format corresponding to the format code from the display format storage means, when the format code is sensed, and then to display the received data in the display format on the display.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 3 shows the memory structure of the D-ROM 10 in FIG. 1;

FIGS. 4A to 4C show various display format data items stored in the D-ROM 10 of FIG. 1;

FIG. 10 shows the structure of the automatic setting flag area 211;

FIG. 11 shows a character code matrix stored in the P-ROM 22;

FIG. 12 shows a job content table stored in the P-ROM 22;

FIG. 14 shows the structure of the item code data memory CD stored in the D-ROM 24;

FIG. 15 shows the structure of the display format data memory FD stored in the D-ROM 24;

FIG. 16 shows the structure of the TEL bank memory TB stored in the D-ROM 24;

FIG. 18 is a flowchart for a setting process executed by a pager according to the second embodiment;

FIG. 24 is a view of a display example appearing on the LCD 15 of FIG. 9 on the basis of the setting process executed by the pager according to the second embodiment;

FIG. 25 is a view of a display example appearing on the LCD 15 of FIG. 9 on the basis of the setting process executed by the pager according to the second embodiment;

FIG. 26 is a view of a display example appearing on the LCD 15 of FIG. 9 on the basis of the setting process executed by the pager according to the second embodiment;

FIG. 28 shows the way of storing the messages corresponding to the message data items stored in the job content memory area in the call incoming process executed the pager according to the second embodiment;

DETAILED DESCRIPTION OF THE PREFERRED EMBODIMENTS

Hereinafter, referring to FIGS. 1 to 33, embodiments of the present invention will be explained.

FIGS. 1 to 8 show a first embodiment of a pager to which a receiving device of the present invention is applied.

First, the configuration will be described.

Figure 1:
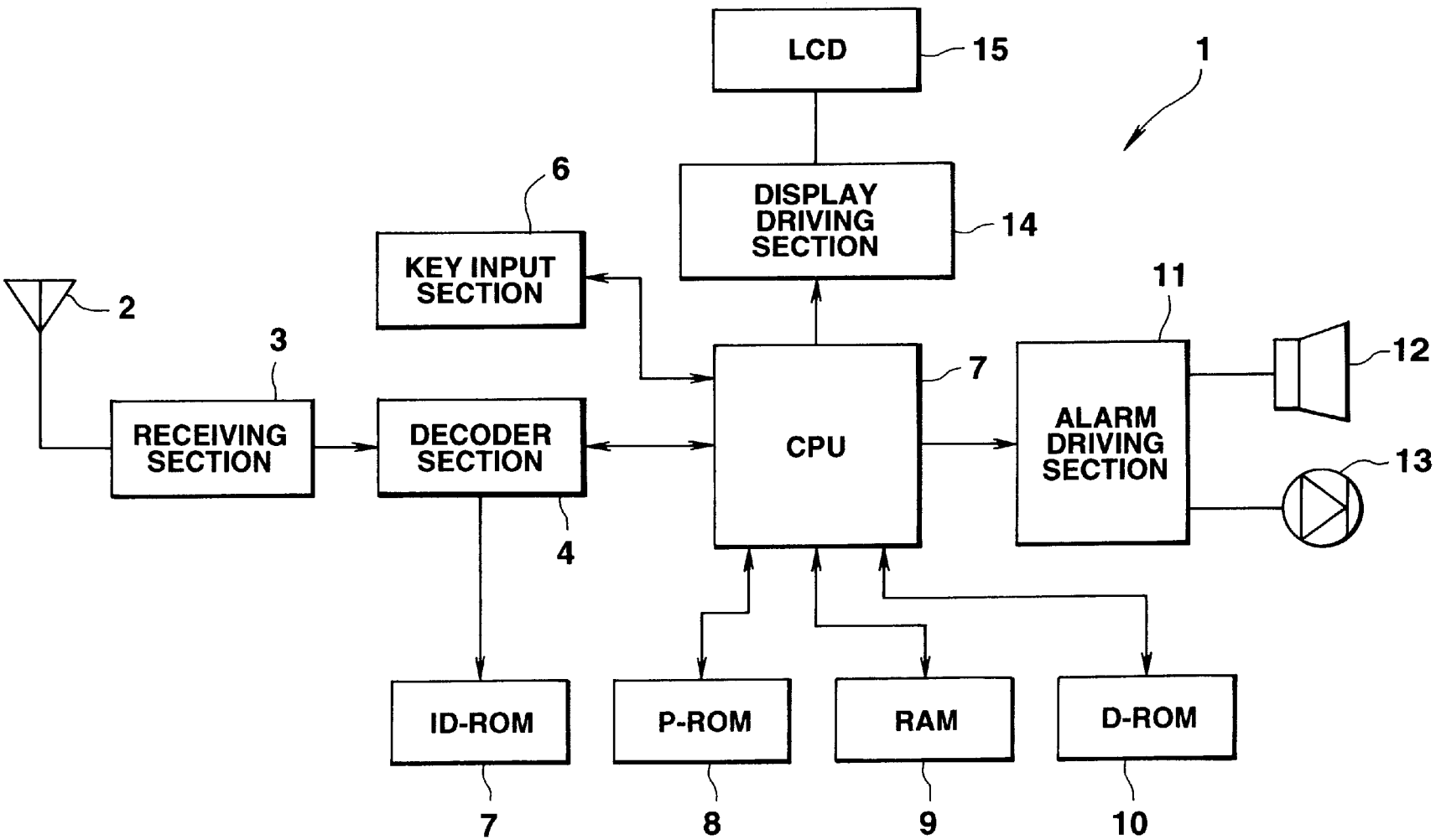
FIG. 1 is a block diagram of a pager according to a first embodiment to which a receiving terminal of the present invention is applied.

FIG. 1 is a block diagram of a pager 1.

In the figure, the pager 1 comprises an antenna 2, a receiving section 3, a decoder section 4, an ID-ROM 5, a key input section 6, a CPU 7, a P-ROM 8, a RAM 9, a D-ROM 10, an alarm driving section 11, a speaker 12, an LED 13, a display driving section 14, and an LCD 16.

The antenna 2 receives a call signal transmitted by radio from a pager service company (not shown) and outputs it to the receiving section 3. The receiving section 3 is controlled by the intermittent signal from the decoder section 4, intermittently receives the call signal from the antenna 2, detects and demodulates the received signal, converts the demodulated signal into digital data, and then outputs the digital data to the decoder section 4.

The decoder section 4 judges whether or not the call number from the receiving section 3 coincides with its own call number, with the help of the ID-ROM 5 in which its own call number has been entered. If they coincide with each other, it will cause the receiving section 3 to continue reception and outputs a pager-1 call sense signal to the CPU 7. On the basis of the request from the CPU 7, the decoder section 4 also outputs the message information arrived together with the call signal to the CPU 7.

The ID-ROM 5 forms a memory area into which its own call number is entered.

The key input section 6 is composed of numeric keys, mode keys, and power switches and outputs the instruction signal from each key input operation.

The CPU (Central Processing Unit) 7 stores the message data from the decoder section 4 in the RAM 9 on the basis of various control programs stored in the P-ROM 8, controls each section of the pager 1 according to the input instruction signal from the key input section 6, and temporarily stores the incoming message data and the key input data from the key input section 6. Thereafter, the CPU outputs these data items to the LCD 15, which displays them. On the basis of the incoming data arrived, the CPU also causes the alarm driving section 11 to actuate the speaker 12 or forces the LED 13 to blink to inform the user of the incoming.

When sensing that a format code specifying a display format is added to the head of the message data in the call incoming process explained later, the CPU 7 develops the display content data read from the D-ROM 10 according to the format No. contained in the format code, that is, the corresponding display format, so that the data may be arranged in each position in the display format, thereby displaying the data on the LCD 15.

The P-ROM (Read Only Memory) 8 is a program ROM and stores various control programs that the CPU 7 executes.

Figure 2:
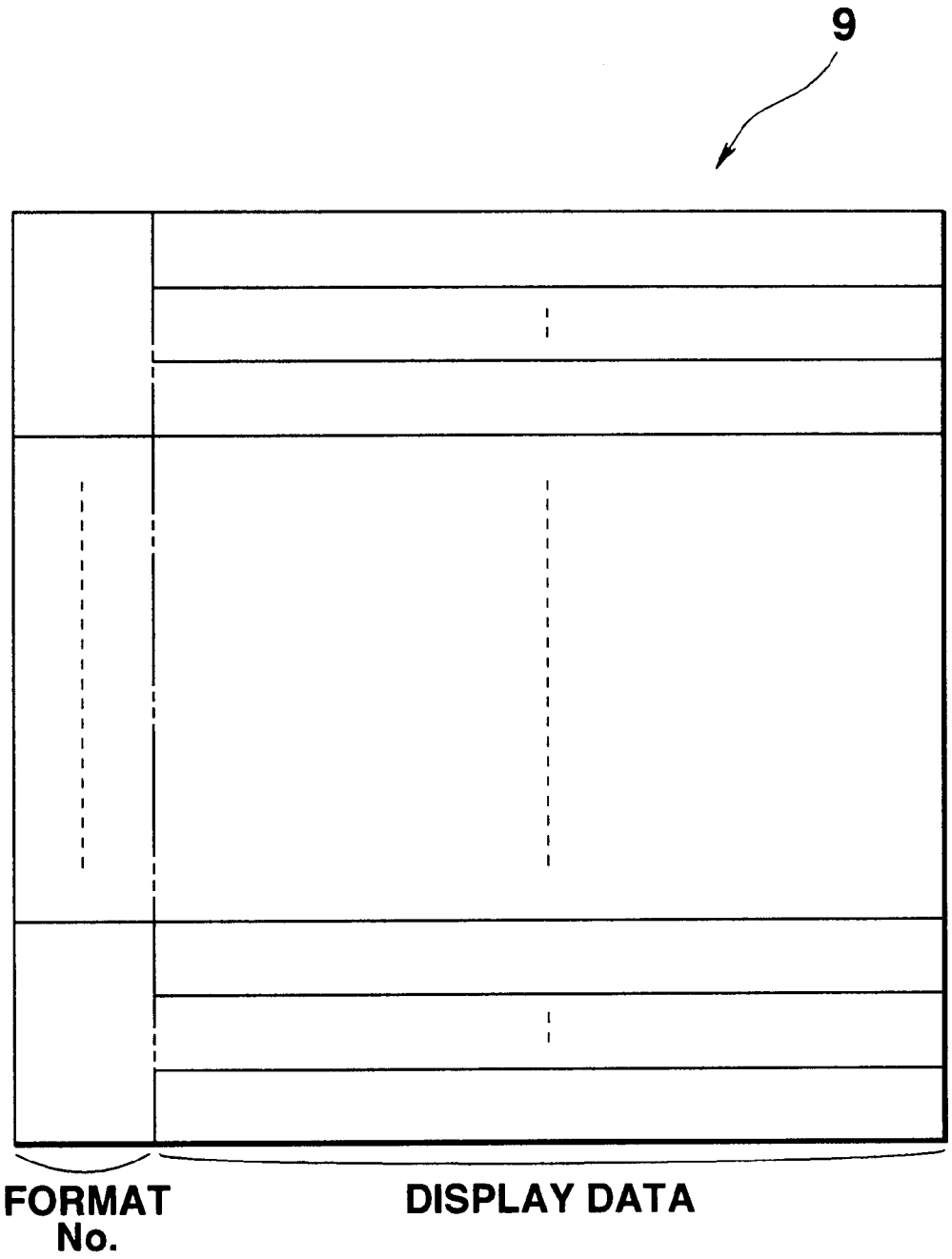
FIG. 2 shows the memory structure of the RAM in FIG. 1.

The RAM (Random Access Memory) 9 forms a memory area that temporarily stores the incoming data from the CPU 7 and the key input data. It also forms a memory area that stores the corresponding display data by format No. as shown in FIG. 2.

The D-ROM 10 is a data ROM composed of electrically rewritable EEPROM. As shown in FIG. 3, it stores format Nos. and display formats in such a manner that they correspond to each other. Then, the D-ROM 10 organizes various display formats as shown in FIGS. 4A to 4C corresponding to the format No. added to the message data so as to form suitable data items and stores them separately.

For example, FIG. 4A shows a display format for displaying stock-price information, FIG. 4B shows a display format for displaying inventory information, and FIG. 4C shows a display format for displaying schedules. These display formats are assigned "05", "10", and "30" as the format Nos. contained in the format codes, for example. In the figures, the development areas indicating the specified display places of the received display contents are secured by "- - - - ".

The alarm driving section 11 causes the speaker 12 to output alarm sound according to the alarm data inputted from the CPU 7. It also forces the LED 13 to blink to inform the user of the incoming. The display driving section 14 drives the LCD (Liquid Crystal Display) 15 according to the display control data inputted from the CPU 7 so as to display the display contents based on the message data.

Explained next will be the operation of the embodiment.

Figure 5:
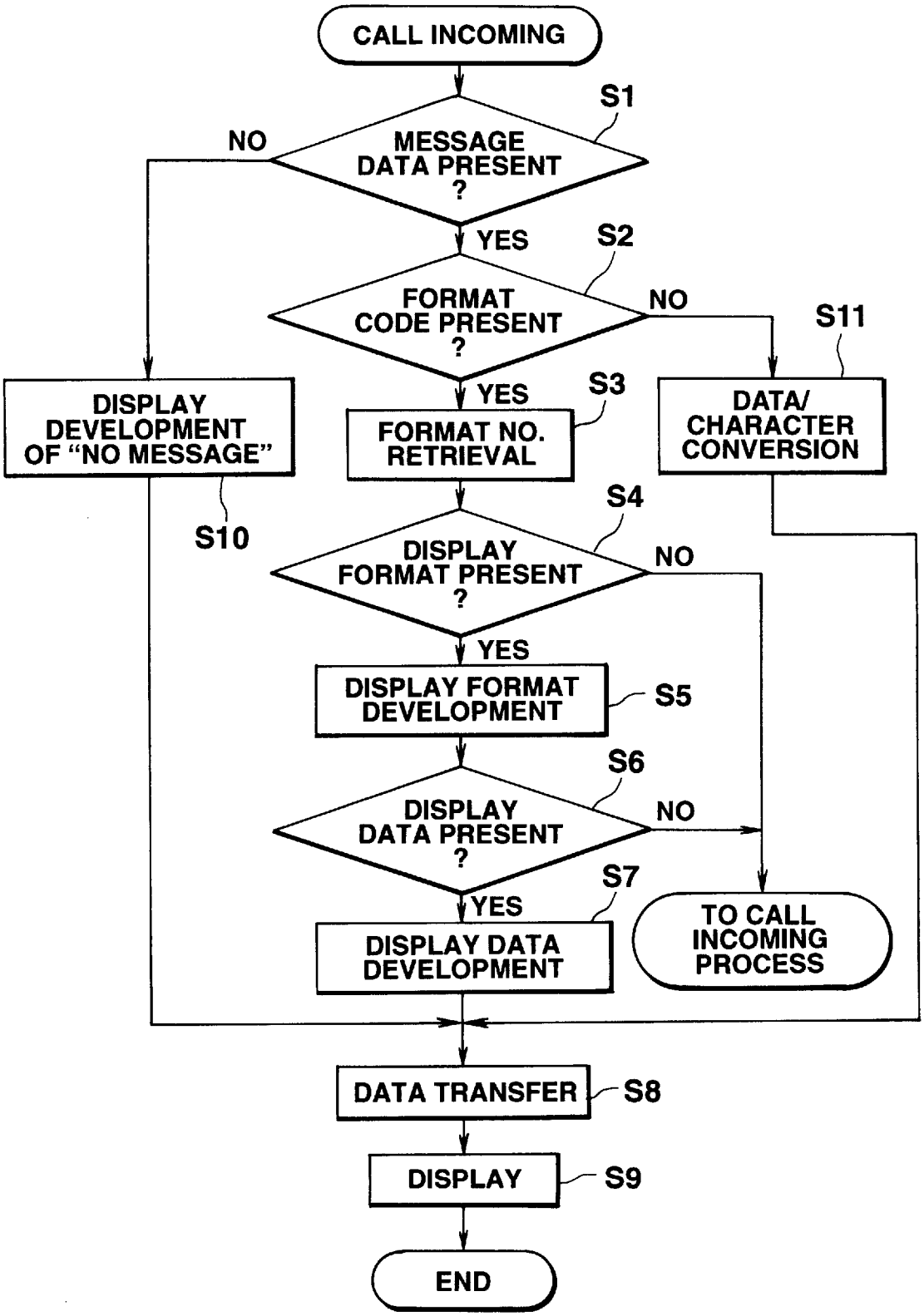
FIG. 5 is a flowchart for a call incoming process executed by the pager of the first embodiment.

Using the flowchart of FIG. 5, the call incoming process in the pager 1 will be described.

First, the pager 1 judges whether or not the call number transmitted from a pager service company coincides with its own call number stored in the ID-ROM 5. If they coincide with each other, it will cause the receiving section 3 to continue operation and judge whether or not the data from the decoder section 4 contains the message data following the call sense signal (step S1).

If the message data is present, the pager will take in the received data, temporarily store it in the RAM 9, and judges whether or not a format code is present at the head of the message data (step S2). If the format code is present, the pager will check to see if the display format corresponding to the format No. contained in the format code has been entered in the D-ROM 10 (steps S3 and S4). If the corresponding display format data is entered, the pager will develop the display format on the RAM 9 (step S5).

After the development of the display format is complete, the pager judges whether or not the display data exists after the format code (step S6). If the display data exists, the pager will develop the display data over the display format previously developed on the RAM 9 (step S7), transfer these two data items to the display driving section 14 (step S8), display them on the LCD 15 (step S9), and terminate the present process.

If at step S1, the pager has not received the message data, it will cause the alarm driving section 11 to carry out the incoming alarm process only, develop the display data of "No Message" on the RAM 9 (step S10), transfer the developed message data to the display driving section 14 (step S8), display it on the LCD (step S9), and terminate the present process.

The display data appearing on the LCD 15 is sorted out by the format No. of the developed display format and stored sequentially in the area divided by format No. in the memory area in the RAM 9.

If at step S2, there is no format code, all of the message data will be displayed. Therefore, the pager will convert the data into the corresponding character data (step S11), transfer the converted character data to the display driving section 14 (step S8), display it in a normal display format (step S9), and terminate the present process.

If at step S4, the format No. corresponding to the format code is not set, or at step S6, there is no display data following the format code, the pager will determine that there has been no incoming and pass control to the call incoming waiting process.

An example of developing the message data in the call incoming process in the pager 1 will be described with reference to FIGS. 6 and 7.

Figure 6A:
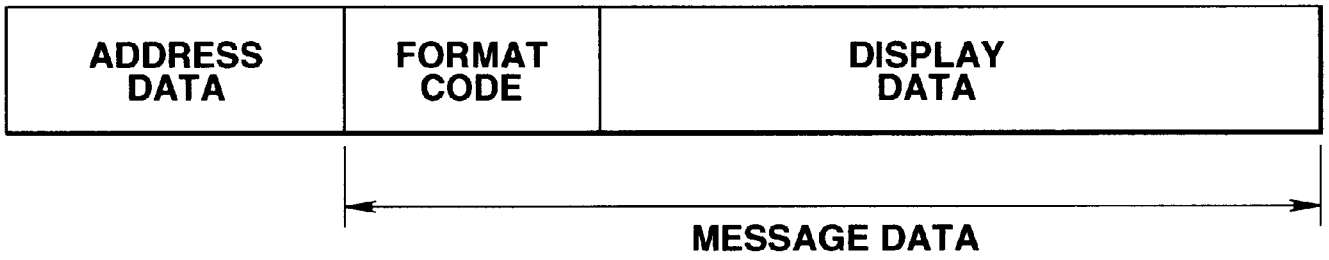
FIGS. 6A and 6B show the structures of data transmitted to the pager of the first embodiment.
Figure 7:
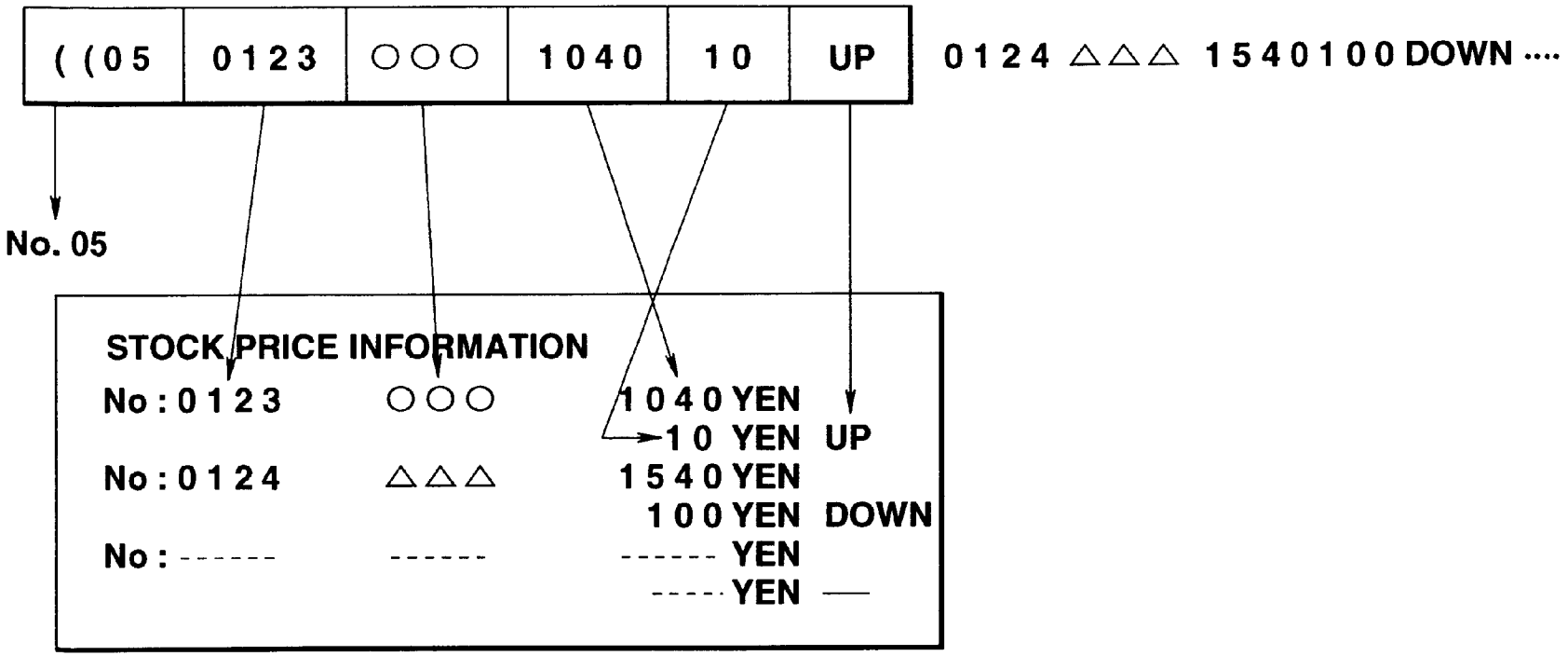
FIG. 7 shows the way of developing the display data in the individual display positions on the display format developed on the RAM 9.

FIG. 6A shows an example of the structure of the message data arrived at the pager 1, where the address data (the call number of the pager 1), the format code, and the display data are arranged in that order, starting at the head. When the transmission side transmits the data to the pager 1, the individual data items are arranged in that order and transmitted.

For example, shown below will be an example of the data set in the format code and display data sections following the address data when the data on stock-price information has arrived at the pager 1.

"((050123 ○○○1040 10 up
0124 ΔΔΔ1540 100 down"

In this data, "((05" is the format code. The data following the format code is the display data. As the display contents, "0123 ○○○1040 10 up" and "0124 ΔΔΔ1540100 down" constitute a series of display data items in developing the data on the area in the displayed format.

In the series of display data items, "0123" and "0124" indicate issue codes, "○○○" and "ΔΔΔ" indicate issues, "1040" and "1540" indicate stock price, and "10", "up" and "100", "down" indicate fluctuations in the stock price and fluctuation values.

Therefore, when sensing the incoming of the message data "((050123 ○○○1040 10 up 0124 ΔΔΔ1540100 down", the pager 1 judges the format No. of the format code indicated by "((05", reads the display format for arranging and displaying the stock-price information "05" shown in FIG. 4(*a*) from the D-ROM 10 as the data corresponding to the format code "((05", and develops it on the RAM 9.

Then, the pager judges the series of display data "0123 ○○○1040 10 up" and "0124 ΔΔΔ1540100 down" by item one by one with the help of space data, thereby developing the display data in the corresponding individual display positions on the developed format. Then, the pager transfers the developed message data to the display driving section 14, which causes the LCD 15 to display it.

Similarly, when the display format for the inventory information for goods of FIG. 4B and the display format for schedules of FIG. 4C are specified by the format No. contained in the format code in the message data, the pager 1 reads the corresponding display format from the D-ROM 10 and develops it on the RAM 9, and likewise judges the display data items by item one by one and develop them, thereby displaying them on the LCD 15.

As described above, by storing the display formats for displaying the data in fixed display formats in the pager 1, receiving only the format code specifying the display format and the data display data makes it possible to display the data in a fixed display format and reduce the amount of data. The present embodiment can be applied effectively to a character display pager capable of transmitting information service with a lot of display data and individual information.

While in the embodiment, the character display data is displayed on the specified display format on the basis of the received format code, it is possible to change the settings in the D-ROM 10 on the basis of the received message data, provided that the D-ROM 10 is composed of an electrically rewritable EEROM.

Figure 6B:
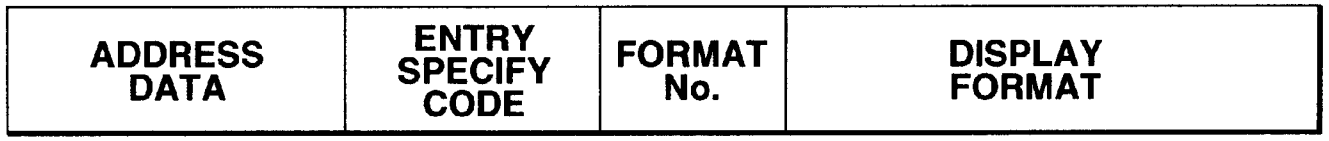

FIG. 6B shows the structure of the data to rewrite the settings of the display format stored in the D-ROM 10 in the message data arrived at the pager 1, where the address data (the call number of the pager 1), the entry specify code for specifying rewriting, the format No. of the display format to be rewritten, and the display format are arranged in that order, starting at the head. When the transmission side transmits the contents for rewriting the display format in the D-ROM 10 to the pager 1, the individual data items are arranged in that order and transmitted.

Figure 8:
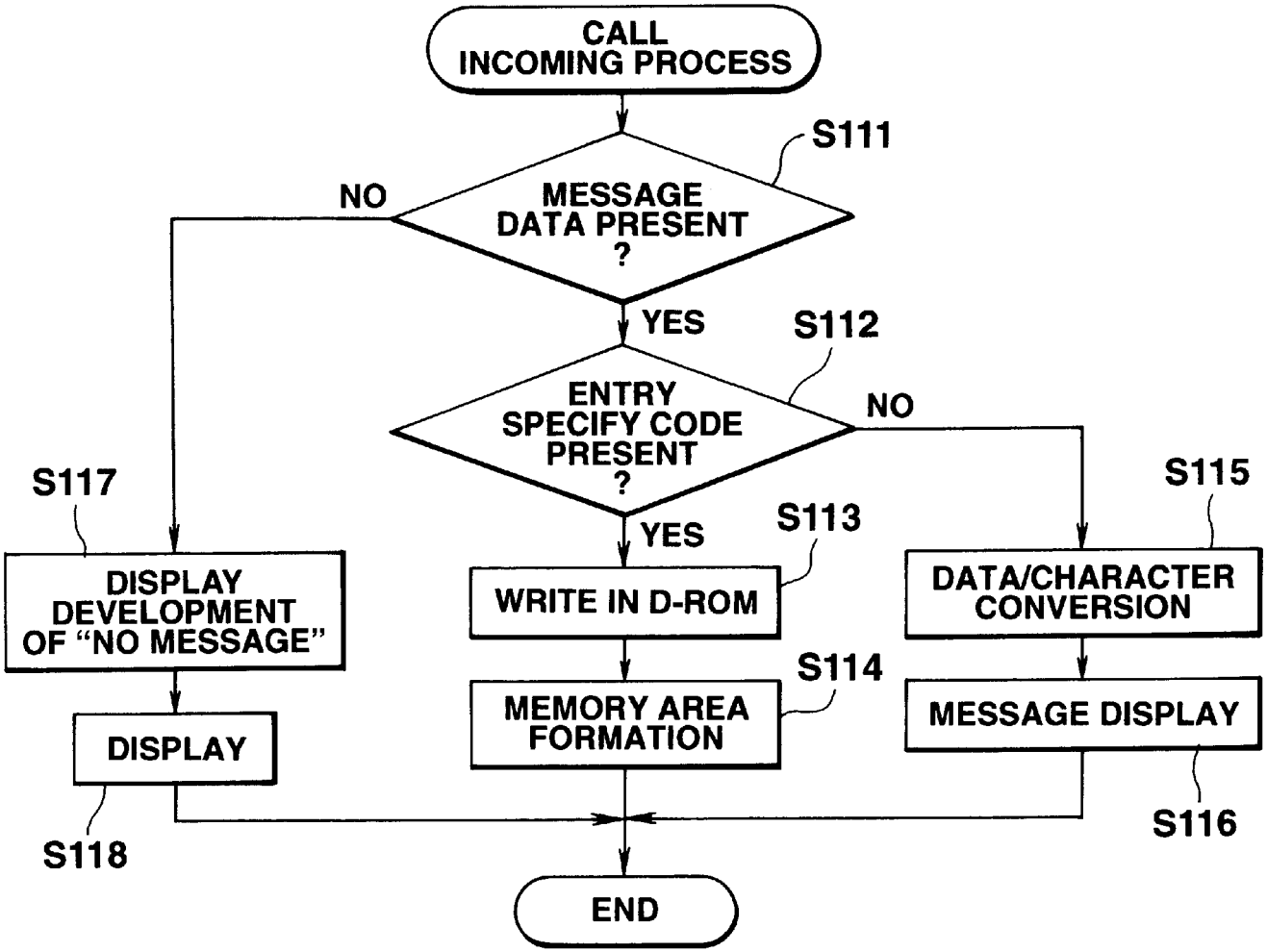
FIG. 8 is a flowchart for the call incoming process executed by the pager in receiving the transmitted data in FIG. 6B.

Using the flowchart of FIG. 8, the call incoming process in the pager 1 in receiving the incoming data of FIG. 6B with the pager 1 will be described.

First, when sensing the incoming of the call signal to the pager 1 transmitted from a pager service company, the pager 1 judges whether or not the call number coincides with its own call number stored in the ID-ROM 5. If they coincide with each other, it will cause the receiving section 3 to continue operation and judge whether or not the data from the decoder section 4 contains the message data following the call sense signal (step S111).

If the message data is present, the pager will judges whether or not an entry specify code is present at the head of the message data (step S112). If the entry code is present, the pager will newly write the format No. and display format set after the entry specify code into the D-ROM 10 so that they may correspond to each other (step S113), form a memory area corresponding to the format No. in the RAM 9 (step S114), and terminate the present process.

If the contents following the entry specify code is the display format of the format No. already stored in the D-ROM 10, the pager will overwrite the display format of the received format No., thereby changing the display format.

If at step S112, there is no entry specify code, all of the message data will be displayed. Therefore, the pager will convert the data into the corresponding character data (step S115), transfer the converted character data to the display driving section 14, display it on the LCD 15 in a normal display format (step S116), and terminate the present process.

If at step S111, the pager has judged that there is no message data, it will cause the alarm driving section 11 to carry out the incoming alarm process only, develop the display data of "No Message" on the RAM 9 (step S117), transfer the developed message data to the display driving section 14, display it on the LCD 15 (step S118), and terminate the present process.

As described above, with the first embodiment, as a result of storing the display formats for displaying the data in fixed display formats in the pager, the transmission side has only to transmit the entry specify code, the new format No., and the display format in transmitting the data for addition or change to the pager 1. This facilitates the rewriting of the contents of the D-ROM 10 attributable to information service or the addition or change of individual information.

Furthermore, the memory space of the D-ROM 10 storing the display formats can be used effectively.

Additionally, with the first embodiment, the reduction of the amount of data in transmission can be reduced, and the continuous driving time required for the pager to receive the message can be shortened, resulting in a decrease in the power consumption of the pager 1 and consequently a longer service life of the battery.

While in the embodiment, the rewriting and updating of the display formats stored in the D-ROM 10 can be effected by the reception of the individual call signal, the present invention is not limited to this. For instance, the body of the pager 1 may be provided with an infrared light-receiving section, thereby receives an infrared signal indicating the rewriting or updating of the display format.

FIGS. 9 to 33 show a second embodiment of a pager to which a receiving terminal of the present invention is applied.

First, the configuration will be described.

Figure 9:
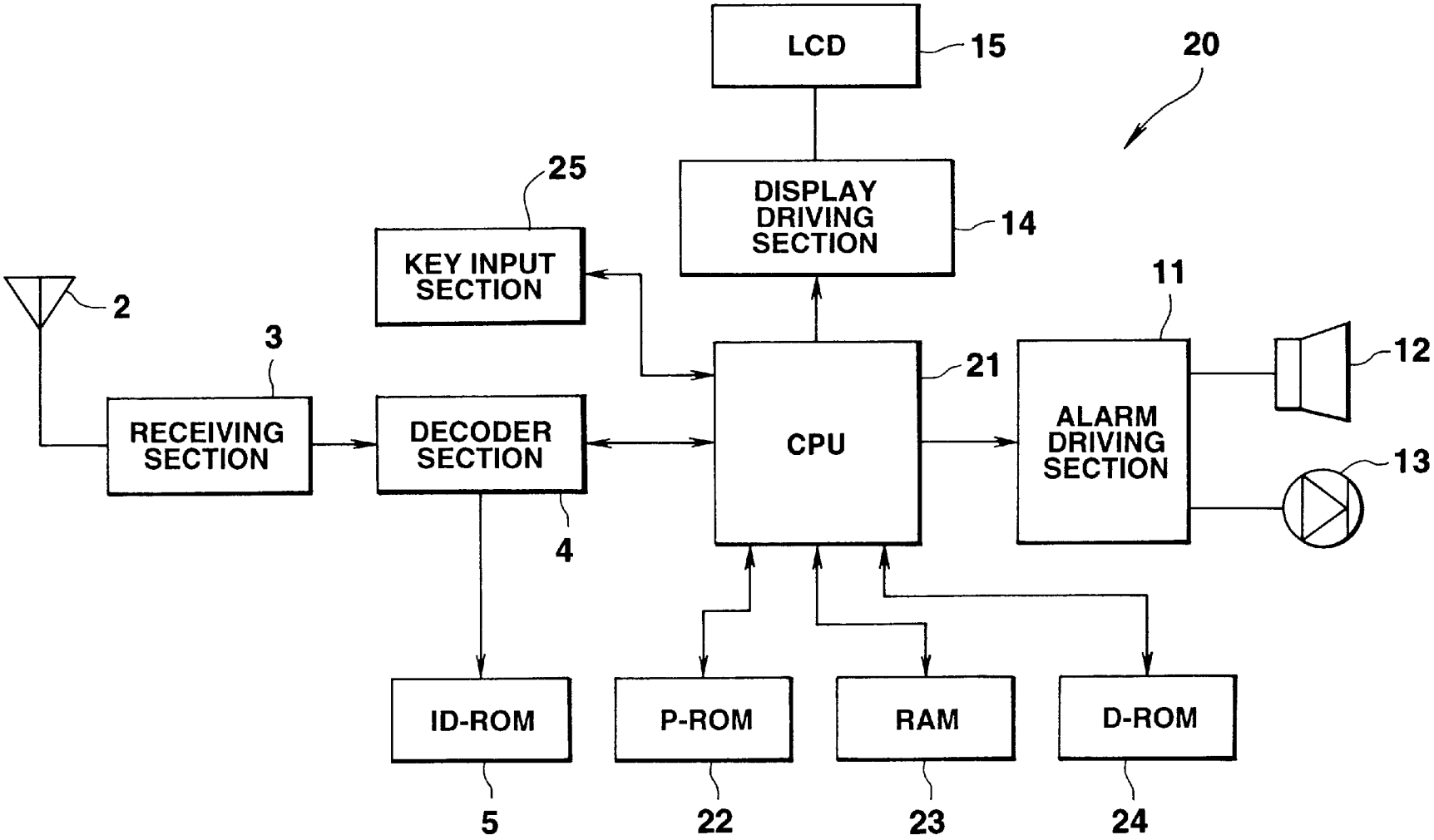
FIG. 9 is a block diagram of a pager according to a second embodiment to which a receiving device of the present invention is applied.

FIG. 9 is a block diagram of a pager 20. The same parts as those of the pager 1 are indicated by the same reference numerals and their explanation will not be given.

In the figure, the pager 20 comprises an antenna 2, a receiving section 3, a decoder section 4, an ID-ROM 5, a key input section 25, a CPU 21, a P-ROM 22, a RAM 23, a D-ROM 24, an alarm driving section 11, a speaker 12, an LED 13, a display driving section 14, and an LCD 16.

The CPU 21 stores the message data from the decoder section 4 in the RAM 23 on the basis of various control programs stored in the P-ROM 22, controls each section of the pager 20 according to the input instruction signal from the key input section 25, and temporarily stores the incoming message data and the key input data from the key input section 25 into a buffer (not shown). Thereafter, the CPU drives the display driving section 14 to cause the LCD 15 to display the message data and the display contents based on the key input data. After a call signal to the pager 20 has been received, the decoder section 4 inputs a call sense signal to the CPU. Then, the CPU causes the decoder section 4 to continue reception. It also drives the alarm driving section 11 to actuate the speaker 1 and turns on the LED 13, thereby informing the user of a call.

Furthermore, the CPU 21 contains an automatic setting flag area 211 shown in FIG. 10.

In storing the message data in the D-ROM 24, it is judged from the up or down of the flag whether the setting of the selection of the message memory area MA and the rearrangement of the incoming message data is effected on the basis of the judgment of the CPU 21 automatically, or according to the instruction from the user. In a data allocation setting process explained later, the setting and changing can be effected by the key input operation by the user. These flags are used as judgment criteria in the call incoming process explained later, when the job code added to the head of the message data has been sensed or when the item code has been sensed in the message data.

For example, when a job code (format code) added to the head of the message data has been sensed in the call incoming process, the state of the area selection flag in the automatic setting flag area 211 is referred to. If the flag is up, the message data will be stored in the job memory area corresponding to the message memory MA in the D-ROM 24 on the basis of the identification information in the job code added to the message data. If the flag is down, the message data will be left stored in the RAM 23 until the instruction from the key input section has arrived, regardless of the presence/absence of the job code.

If an item code added to the message data has been sensed when the message data read from the RAM 23 is sorted out and stored in the D-ROM 24, the state of the data rearrangement flag in the automatic setting flag area 211 is referred to. If the flag is up, the message data will be stored in the address according to the priority of the corresponding job memory area on the basis of the priority given to the item code. If the flag is down, the message data will be left stored in the RAM 23 until the instruction from the key input section has arrived, regardless of the presence/absence of the item code.

The P-ROM 22 is a program ROM and stores various control programs that the CPU 21 executes. It also stores a character code matrix for a character generator and that for free messages. The character code matrix for free messages contains katakana characters, alphabets, numerals, and symbols corresponding to two-digit numbers as shown in FIG. 11. For instance, specifying code "27" gives the alphabet G and specifying code "63" gives the katakana character "フ(fu)".

The P-ROM 22 also stores a job content table shown in FIG. 12. The job content table stores "Message Title" displayed in the first line on the display format, a plurality of item titles displayed in the individual lines on the display format, including "Address" and "Addresser", by job content such as "Please Call Me" or "Meeting." In a display format setting process explained later, when the user has inputted and acknowledged a job code by key operation, the CPU 21 sets the job code in the display format data memory FD, reads the job contents from the job content table, and displays it on the LCD 15. When sensing the acknowledgment of the job contents by the user, the CPU 21 displays the job message corresponding to the job contents and a plurality of item titles corresponding to the job contents on the LCD 15 in the form of an item title menu.

The RAM 23 forms a memory area that temporarily stores the key input data and the incoming data that is inputted from the CPU 21 and is about to be stored in the D-ROM 24.

Figure 13:
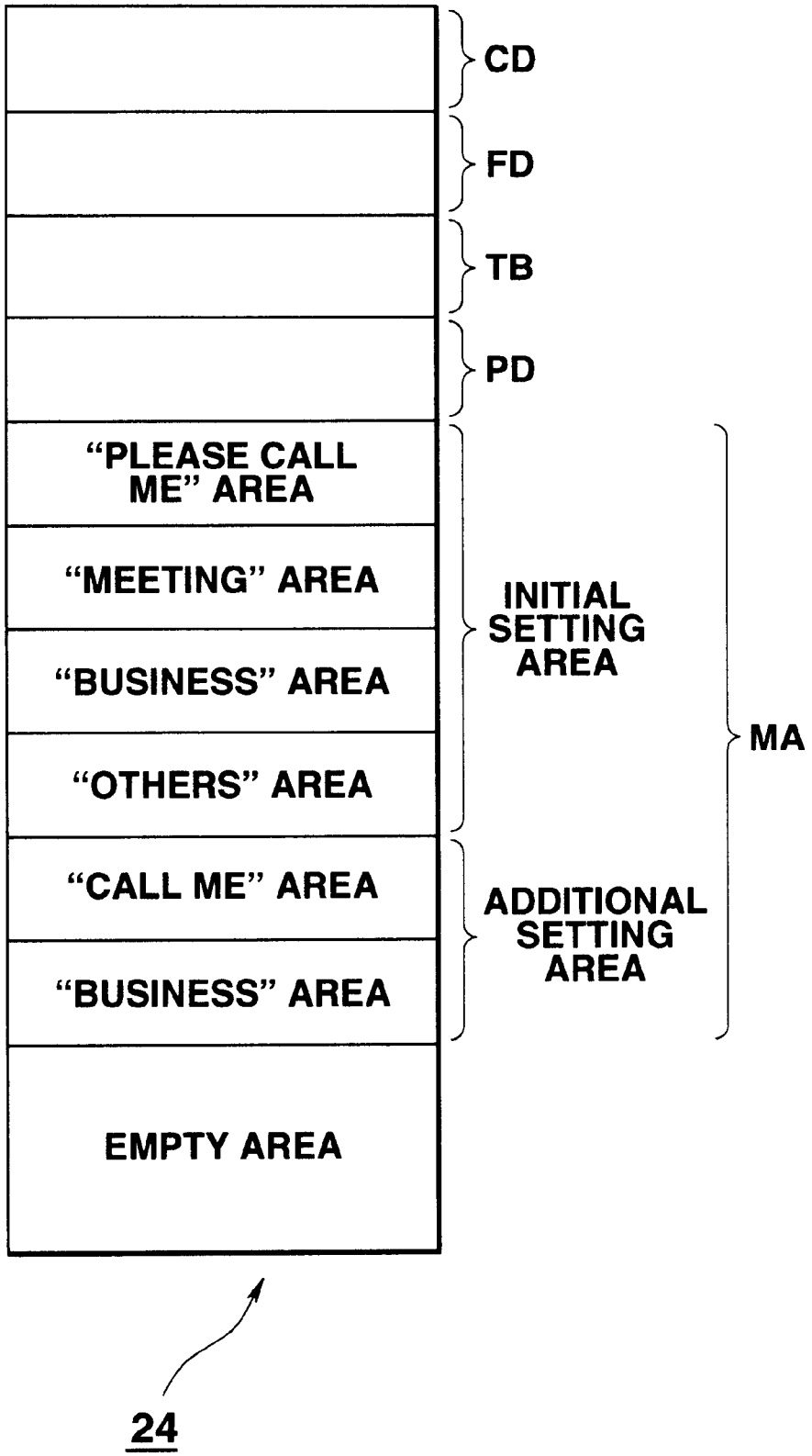
FIG. 13 shows the structure of the memory area of the D-ROM 24.

The D-ROM 24 is a data ROM composed of electrically rewritable EEPROM. The D-ROM 24 has a memory structure as shown in FIG. 13, which divided into item code data memory CD, display format data memory FD, TEL bank memory TB, priority data memory PD, and message memory MA.

The item code data memory CD has a memory structure as shown in FIG. 14 and stores item codes set by "*+(one-digit number)" and kinds of item that "Name" and "Place" in such a manner that they correspond to each other.

The kinds of item are such that in the incoming message data, pieces of item information displayed frequently, such as incoming time, addresser's name, address, and meeting time, are designed to be identified by item codes. For instance, in the job content table, although the item title "Addresser's Name" of the job contents "Please Call Me" differs from the item title "Client's Name" of the job contents "Job" in item title, they agree with each other in that they display "Name", the item information based on the kinds of item. The transmitter who knows the correspondence between "Kinds of Item" and "Item Codes" previously, adds the item code "*1" corresponding to "Name" to the head of the item information so that the item information "Addresser's Name" can be identified by "Name" in transmitting the message "Please Call Me" as the job contents. Then, the pager 20 recognizes that the item information that can be identified by the kind of item "Name" exists in the received message data.

In kind of these item, data distinction flags for distinguishing between data structures of item information are set by item code. If the item information has a data structure that can be distinguished by kind of item "Time" (:), the flag will be set. If the item information indicates character data, the flag will be reset.

Furthermore, the item code is used not only to set a display format in a setting process explained later, but also to determine the order in which the message data to the D-ROM 24 is rearranged. In addition, the correspondence between the item codes and item information can be entered newly, changed, and deleted in the display format setting.

The display format data memory FD stores the job codes (format codes) set by "*+(two-digit number)" to identify the job contents including "Please Call Me" or "Meeting" in the message data and the actually displayed display format in such a manner that they correspond to each other. In the display format defined by the job code, an item title, an item code, and the kinds of item defined by the item code are grouped into a set, ranging from the second to fifth lines for each job content as shown in FIG. 15. These definitions are set in the D-ROM 24 in the display format setting process explained later.

The data set in the priority item code column is used as criteria for rearrangement of the message data in storing the message data in the D-ROM 24.

For instance, when the job contents "Meeting" is received as the message data and the RAM 23 stores the message data in the D-ROM 24, the data is usually stored in the order of "Incoming Time" on a time stamp (not shown). Because the priority code is "*4" or item information "Meeting Time", "Meeting Time" is given priority over "Incoming Time" in storing the message data. Therefore, the "Meeting" data is arranged in the order of the latest "Meeting Time", not in the order of "Incoming Time" on the time stamp, and stored in the D-ROM 24.

The TEL bank memory TB stores mostly transmitter's names, addresses, and telephone numbers in such a manner that they correspond to the item codes as shown in FIG. 16. When the message data is stored in the D-ROM 24 in such a manner that each data item correspond to each transmitter's name, priority is set as criteria for rearrangement of the message data.

The priority data memory PD stores keywords possibly contained in the item information as comparison condition item by item, when the item information corresponding to the kinds of item of the priority item code in the message data has no time data structure unlike "Incoming Time" or "Meeting Time". The priority data memory is a memory area that is referred to for a criterion for rearrangement of the message data.

For instance, when the data "Job" is received and the RAM 23 stores this message data in the D-ROM 24, because the priority item code "*2" or the kind of item "Place" is set in the display format corresponding to the "Job" in the display format data memory FD, the message data has the kind of item "Place" rearranged in preference to the others.

Figure 17:
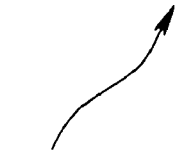
FIG. 17 shows the structure of the priority data memory PD stored in the D-ROM 24.

Because the kind of item "Place" is not time information, the rearrangement of the incoming data is effected by referring to the item information "Work Place" identified by kind of item "Place" and the keyword in the priority data memory area PD shown in FIG. 17.

The setting of these keywords can be effected by referring to the character code matrix shown in FIG. 11, as long as the kind of item is not "Time" when the user sets a priority item code in the display format setting process explained later.

The message memory MA is a memory area that stores the message data identified by a job code with being grouped every job content and is designed to correspond to the job contents set in the display format data memory FD. When a display format is newly set by the job code, a specific amount of memory area is set automatically. When this memory area is filled with the message data, a specific amount of memory area is set additionally. As shown in FIG. 12, "Other" memory areas are set in advance to store the normal message data to which no job code is added.

Like the key input section 6 in the first embodiment, the key input section 25 is provided with numeric keys, a power switch, and mode keys. The mode keys are used to specify the setting mode in which a display format is set in the pager 20 and data allocation is set, and the message reading mode. The key input section is also provided with a cross key for performing selection by moving the cursor to the select specify content displayed on the LCD 15 in the setting process and a setting key for deciding on the selected setting contents.

Figure 19:
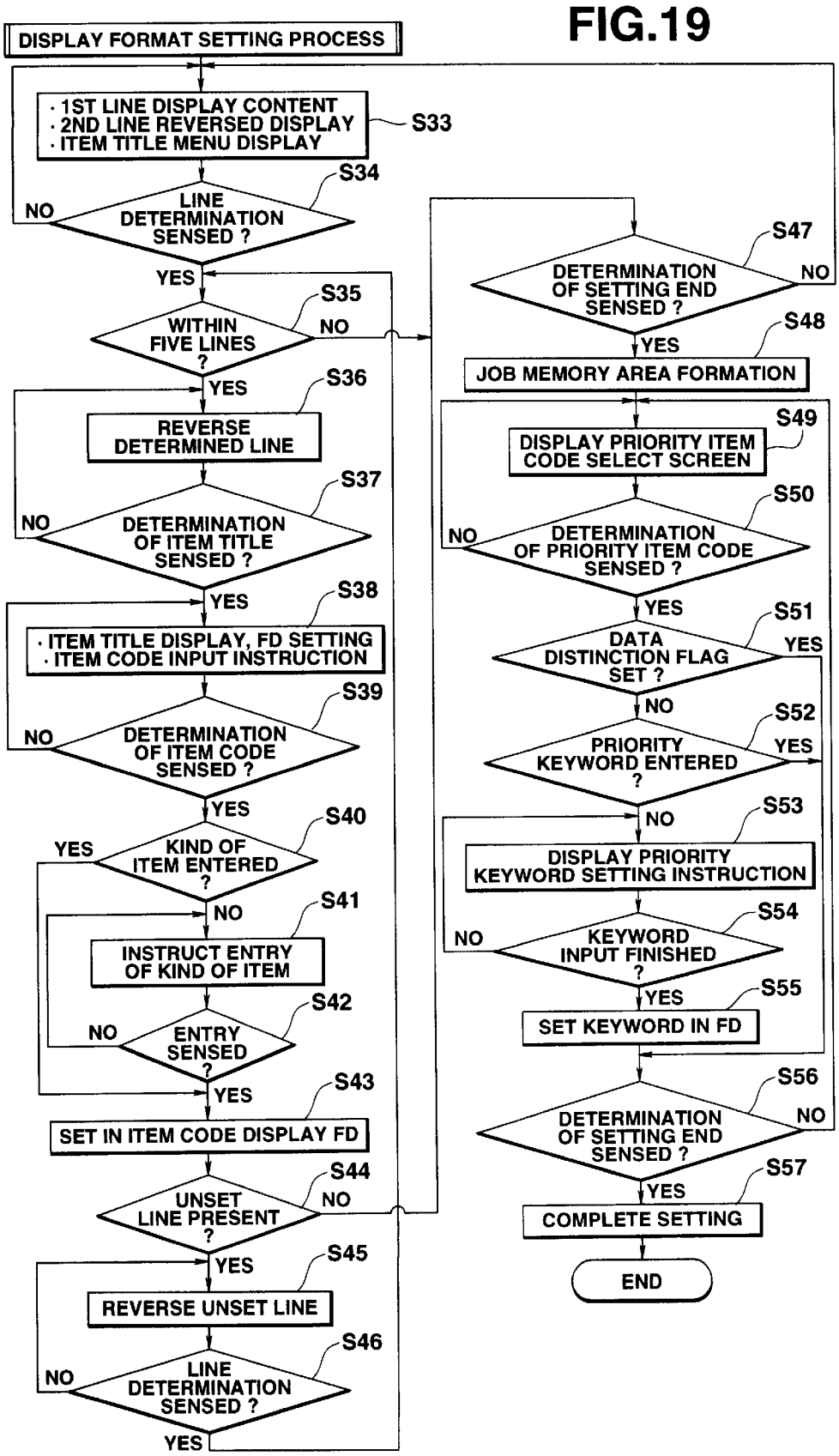
FIG. 19 is a flowchart for a setting process executed by a pager according to the second embodiment.

Using the flowcharts shown in FIGS. 18 and 19 and display examples shown in FIGS. 21 to 25, the process of setting the display format of job content "Meeting" corresponding to job code "*02" in the D-ROM 24 will be explained as an example of setting a display format in the setting mode.

The flow from the power-off state to the display format setting process will be described.

When the power switch is operated in the power-off state, the receiving section 3, under the control of the decoder section 4, effects intermittent driving to receive the frame information set to itself, that is, remains in the incoming call waiting state (step S21).

In this state, it is judged whether or not selection of setting mode has been sensed (step S22). If it is not sensed, the receiving section will return to the incoming call waiting state at step S21.

Figure 21:
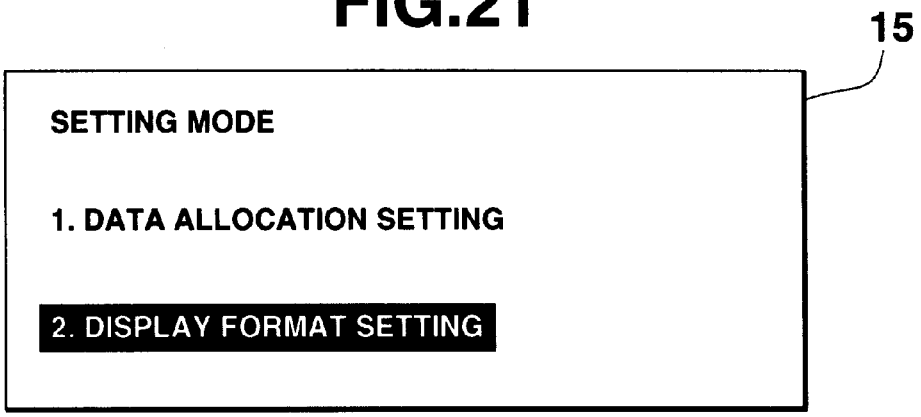
FIG. 21 is a view of a display example appearing on the LCD 15 of FIG. 9 on the basis of the setting process executed by the pager according to the second embodiment.

If selection of setting mode has been sensed, a display screen as shown in FIG. 21 will appear. In this display state, it is sensed whether the user has selected and determined "2. Display Format Setting" (step S23).

After the determination of "2. Display Format Setting" has been sensed, a check is made from the state of the present empty memory in the D-ROM 24 to see if there is enough capacity to accommodate the job memory area in which a specific capacity can be set automatically as a result of new display format setting (step S24).

If there is an enough empty space, the setting of a job code will be prompted at step 27. If it is judged that there is no empty space, the contents will be displayed which allow the user to determine whether the display format stored in the display format data memory FD in the present D-ROM 24 should be modified or deleted (step S26).

If the selection and determination of the modification or deletion of the already set display format have been sensed, the display format corresponding to the job memory area with the smallest amount of message data among the message data items automatically sorted out by job and stored in the D-ROM 24 will be modified or deleted. As a result, all of the message data stored in the job memory area corresponding to the display format to be modified or deleted is deleted. If they have not been sensed, control will return to the incoming call waiting state at step S21.

Figure 22:
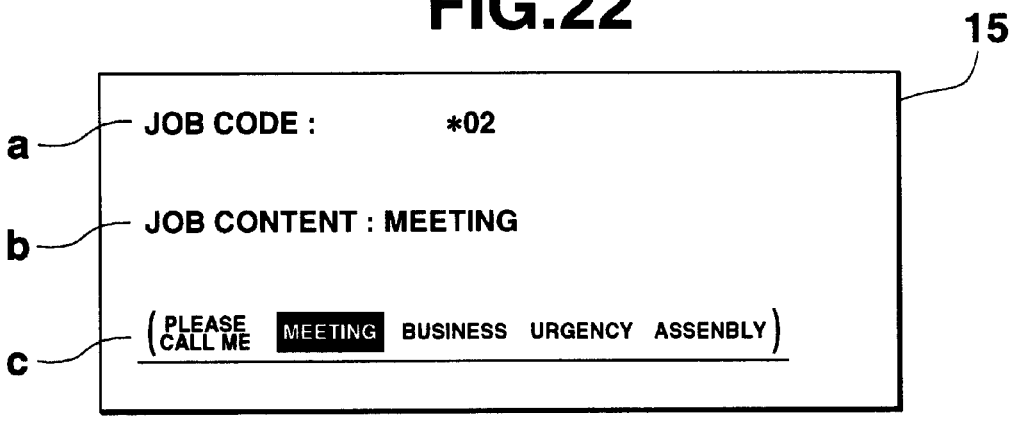
FIG. 22 is a view of a display example appearing on the LCD 15 of FIG. 9 on the basis of the setting process executed by the pager according to the second embodiment.

When there is an empty space left in the memory after the new setting or when the selection and determination of the modification or deletion of the already set display format has been sensed even if there is no empty space, the portion "a" in the display contents of FIG. 22 will be displayed to prompt the user to enter a job code (step S27).

For this display, it is judged whether or not a job code has been inputted and the job code has been determined (step S28). If the determination of a job code has not been sensed, control will go back to step S27.

When the determination of job code "*02" has been sensed, the job content table stored in the P-ROM 22 will be read out and added to portion "a" in the display contents of FIG. 22. Then, portions b and c will be displayed (step S29). Then, the selection and determination of the job contents from a job content menu consisting of a plurality of job contents shown in portion "c" are waited for (step S30).

If the selection and determination of the job content "Meeting" has been sensed, control will proceed to the display format setting process of the job content "Meeting" (step S30). If the selection and determination of the job contents has not been sensed, control will return to step S29.

The display format setting process is such that when the previously inputted job code has been sensed in the message data, the display format of the job contents actually displayed on the LCD 15 is set in the D-ROM 24. Here, using the flowchart of FIG. 19, a case where the user specifies and creates the display format of job content "Meeting" of FIG. 24 and the CPU 21 sets the created display format in the D-ROM 24 will be explained.

Figure 23:
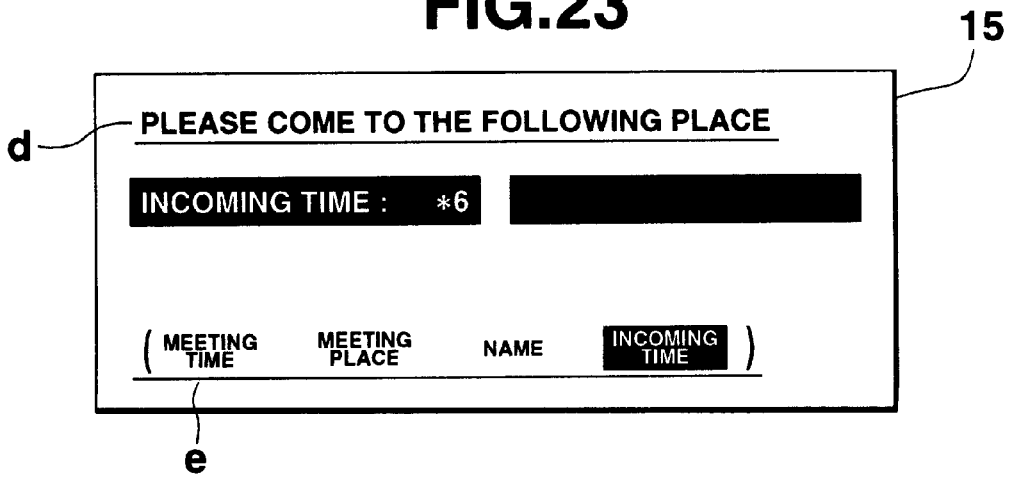
FIG. 23 is a view of a display example appearing on the LCD 15 of FIG. 9 on the basis of the setting process executed by the pager according to the second embodiment.

First, when the determination of job content "Meeting" has been sensed at step S30, the message title "Please come to the following place" corresponding to "Meeting" will be read from the job content table and displayed in portion "d" in the display format of FIG. 23. Additionally, a plurality of display items will be read and displayed in portion "e" as an item title menu.

To prompt the user to input the display item titles and item codes in the second to fifth lines, the second line on the display format is monochromatically reversed (step S33).

Here, the user enters the item titles and item codes one by one in the second to fifth lines. After the user has inputted these titles and codes, the CPU 21 waits for the user's determination of the lines in which the item titles and item titles are set (step S34).

When the determination of a line to be set (the second line in this case) has been sensed, it is judged whether or not the line lies within the five lines previously defined on the display format (step S35).

When it is judged that it lies within the five lines, the line to be set will be monochromatically reversed (step S36).

Next, it is judge whether or not any item title has been selected from the item title menu in portion "e" (step S37).

When the selection of "Incoming Time" has been sensed, the item title "Incoming Time" is displayed in the reversed line. Then, "*02" is set in the job code area, "Meeting" in the job content area, and "Incoming Time" in the item title area in the second line, and then the user is urged to input an item code (step S38).

When the determination of "*6" has been sensed as the item code corresponding to item title "Incoming Time" (step S39), it is judged whether or not the kinds of item corresponding to the item code has been entered in the item code data memory CD (step S40). In the concrete example, because the kind of item "Incoming Time" has been entered so as to correspond to the item code "*6", the item code "*6" is displayed next to item title "Incoming Time" in the determined line, and "*6" is set in the item code area in the second line of the display format data memory (step S43).

FIG. 23 shows a display state accompanying the setting process at steps up to S43. This is a case where the user has entered item title "Incoming Time" and the corresponding item code "*6" in the second line according to the concrete example.

In the setting process up to this point, for instance, at step S35, if the determination of a line beyond the fifth line has been sensed, or when the determination of the sixth line in which an item title menu is displayed has been sensed, the CPU 21 judges that the termination of the display format setting has been specified, and passes control to the judging process at step S47. If at step S40, the kinds of item corresponding to the item code determined and sensed has not been stored in the item code data memory CD, the entry of the kind of item corresponding to the entered item code and the display prompting the setting of the data distinction flag will be developed (step S41), and the sensing of the entry of the kind of item and the setting of the flag will be waited for (step S42). When it is judged that the entry of the kind of item has been sensed and the flag has been set, the setting process is returned to step S43.

At step S43 and later, that is, after the determination of the item code has been sensed, the CPU 21 judges whether or not there are any lines in which item titles and item codes have not been set, or unset lines, in the display format data memory FD concerning the display formats so far set (step S44). If there is any unset line, the unset line will be reversed monochromatically (step S45) and the determination of the line in which an item title and item code are to be entered will be waited for (step S46).

In explanation of the display example of FIG. 23, because the setting process is complete up to the second line, and the third, fourth, and fifth lines have not been set yet, it is judged at step S44 that the result is "Yes."

Therefore, the unset line, or the third line is reversed monochromatically, and the determination of the third, fourth, and fifth lines in which item titles and item codes are to be entered is waited for (step S46).

At step S35, if the determination of the sixth line has been sensed, or at step S44, if it is judged that there is no unset line, the item title menu displayed in the sixth line is changed to display content "Setting End Yes/No" and it is prompted to judge whether or not the setting process of display formats has finished. FIG. 24 shows the display state at step S47. This is the case where the user has determined item title "Meeting Time" and item code "*4" in the third line, item title "Meeting Place" and item code "*2", in the fourth line, and item title "Name" and item code "*1" in the fifth line, by repeating the steps S35 to S44.

In the display state, when "Yes" is sensed, the setting of the display format is considered to have finished and a memory area for storing the message data about job content "Meeting" is set in the empty memory in the D-ROM 24 (step S48).

If "No" is sensed, the correction and deletion of the once set display format is considered to be effected and control is returned to step S33.

After the setting process has been completed so far, then control moves to the setting of priority item codes serving as criteria for rearrangement in storing the message data in the job memory area. The setting process is such that when the message data is stored in the job memory area, the item code corresponding to the desired item content is set in the priority item code area in the display format data memory FD in order to judge which kind of item should be given priority in rearrangement. As a concrete example, explanation will be given about a case where as a result of setting the display format of job content "Meeting", "Time" is set as a priority item code, that is, the massage data is rearranged by giving priority to "Meeting Time" over the other pieces of item information displayed.

FIG. 25 shows the display state at this time, where the previously set item titles and the corresponding item codes appear (step S48).

In this display state, the selection and determination of the item code corresponding to the desired kind of item is waited for (step S50).

When the CPU 21 senses the selection and determination of item code "*4" corresponding to kind of item "Time," it is judged with reference to the item code data memory CD whether or not the data distinction flag of kind of item "Time" has been set (step S51).

Since the data distinction flag of kind of item "Time" is set, it is judge to be "Yes" at step S51, and the determined and sensed item code "*4" is set. On the basis of the sense result of "Yes" or "No" in the display content "Setting Complete Yes/No" in the sixth line in the display example of FIG. 25, it is judged whether or not the setting process of item codes should be completed (step S57).

If "Yes" is sensed, "*4" will be set in the priority item code memory area in the display format data memory FD and a series of display format setting processes will be terminated (step S58).

If "No" is sensed, control returns to step S49, where the selection and determination of the item code will be sensed.

In the processes executed so far, for example, when the data distinction flag of the determined and sensed item code is down, that is, when the kind of item corresponding to the item code is "Character" data, not "Time" data, it is judged whether or not the keyword corresponding to the kind of item is stored in the priority data memory PD (step S52).

When it is judged that the keyword is stored, control will be passed to step S57 because the rearrangement of the message data can be performed by searching the item information corresponding to the kinds of item for the keyword. If the keyword of the kinds of item corresponding to the selected item code is not stored in the priority data memory PD, the display that prompts the user to enter the keyword corresponding to the kind of item of the inputted item code is developed (step S53). Then, the entry of the keyword of a two-digit number defined in the character code matrix is waited for (step S54). When it is judged that the entry of the keyword has been completed, the keyword is set in the kinds of item corresponding to the priority item data memory PD (step S55), and control returns to step S56.

When a plurality of keywords are set, keyword priority is determined in the order in which they have been entered and determined.

Figure 20:
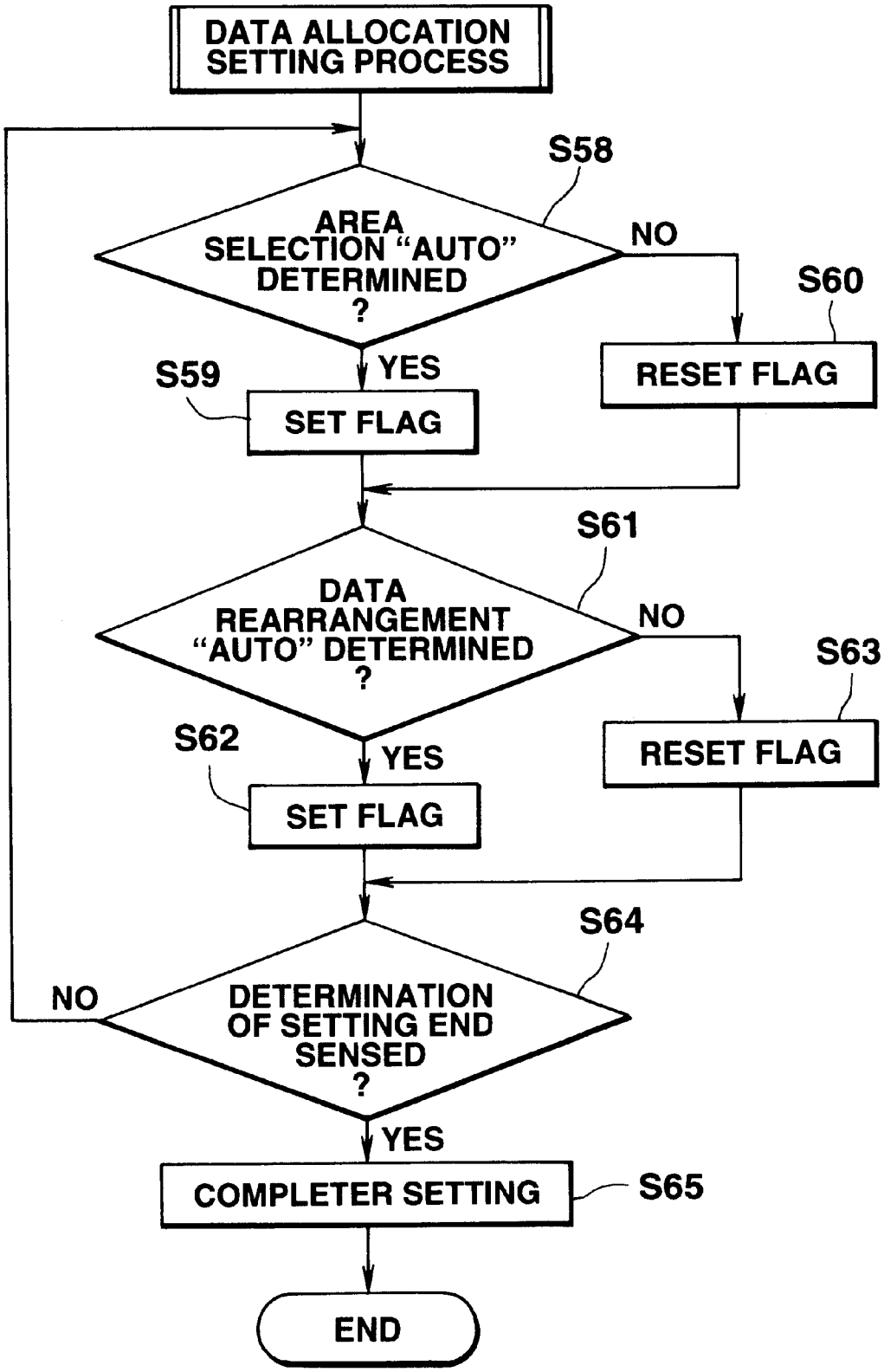
FIG. 20 is a flowchart for a setting process executed by a pager according to the second embodiment.

Using the flowcharts shown in FIGS. 18 and 20 and the display example of FIG. 26, the data allocation setting process in the setting mode will be explained.

The flow from the power-off state to the data allocation setting process will be described.

When the power switch is operated in the power-off state, the receiving section 3, under the control of the decoder section 4, effects intermittent driving to receive the frame information set to itself, that is, remains in the incoming call waiting state (step S21).

In this state, it is judged whether or not the user has selected the setting mode from the mode keys (step S22). If it is not sensed, the receiving section will return to the incoming call waiting state at step S21.

If selection of setting mode has been sensed, a display screen as shown in FIG. 21 will appear. In this display state, it is judged that the user has selected "1. Data Allocation Setting" through a cross-key operation and determined on it by a set-key operation (step S23).

After sensing the determination of "1. Data Allocation Setting", the CPU 21 sets the flag in the automatic setting flag area 211 shown in FIG. 10. FIG. 26 shows the display state of the LCD 15 at this time. When the data allocation setting has been determined, the contents are shown in the display portion "f" which prompt the user to select "AUTO", a process according to the judgment of the CPU 21, or "MANU", a process according to the user's instruction, in connection with "Area Selection" in the message memory area MA on the basis of the job code added to the message data and "Data Rearrangement" of the message data according to priority in the case of an item code added to the message data.

In this display state, the selection and determination by the user is sensed. The CPU 21 judges whether or not "Area Selection" has been selected first and then either "AUTO" or "MANU" has been selected and determined (step S58).

When the selection and determination of "AUTO" has been sensed, it is judged to be area automatic selection and the area selection flag in the automatic setting flag area 211 is set (step S59).

When the selection and determination of "MANU" has been sensed, it is judged to be area manual selection and the area selection flag in the automatic setting flag area 211 is reset (step S60).

Then, the CPU 21 judges whether or not "Data Rearrangement" has been selected and either "AUTO" or "MANU" has been selected and determined (step S61).

When the selection and determination of "AUTO" has been sensed, it is judged to be data rearrangement automatic processing and the data rearrangement flag in the automatic setting flag area 211 is set (step S62).

When the selection and determination of "MENU" has been sensed, it is judged to be data rearrangement manual processing and the data rearrangement flag in the automatic setting flag area 211 is reset (step S63).

The setting is judged by sensing the selection and determination of "Yes" or "No" (step S64).

The end of the setting is judged by sensing the reoperation of the mode key (step S65).

Figure 27:
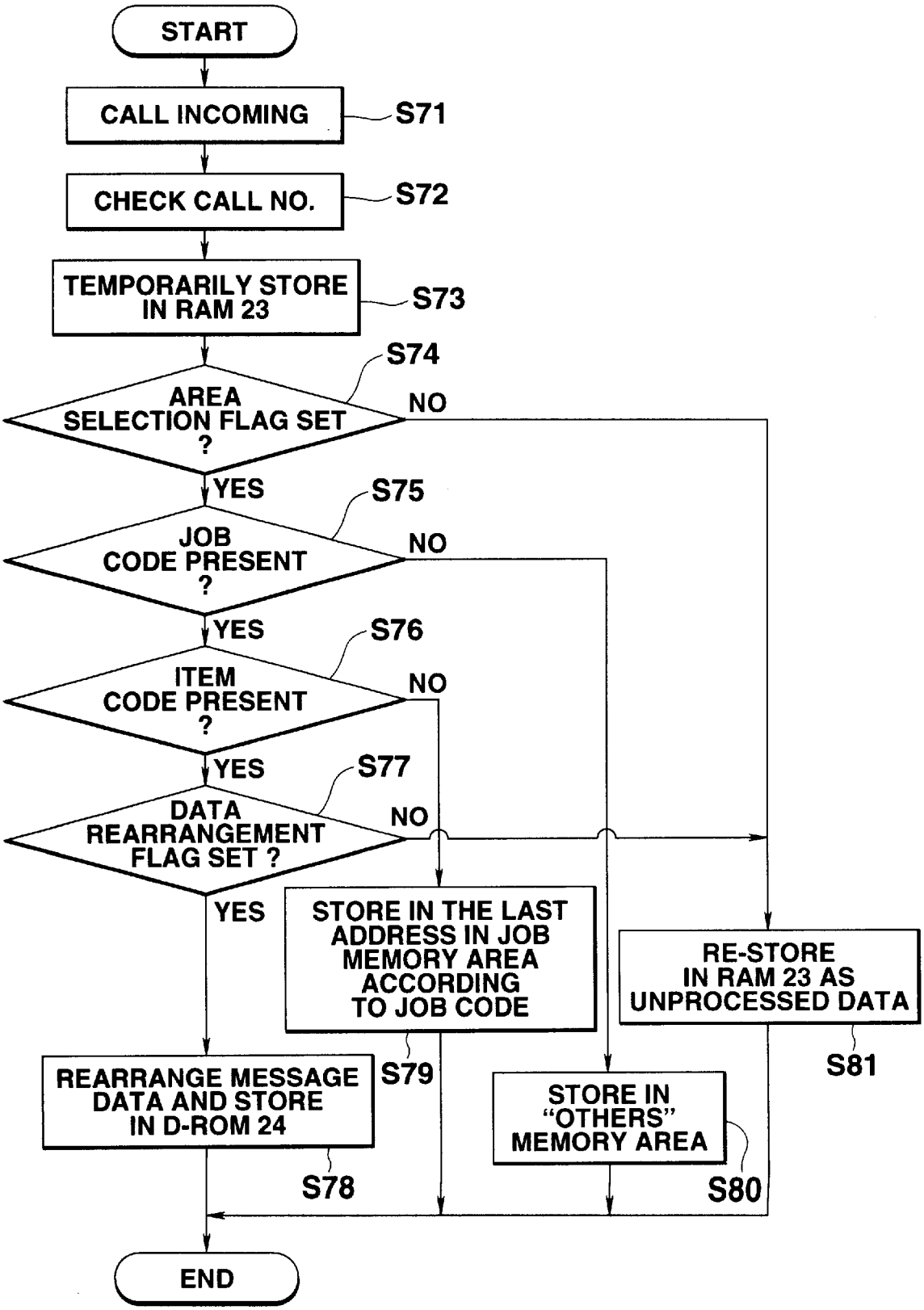
FIG. 27 is a flowchart for the call incoming process executed by the pager according to the second embodiment.

Referring to the flowchart of FIG. 27 and FIGS. 28 and 29, the call incoming and data storage processes in the pager 20 of the second embodiment will be explained.

The pager 20, in the incoming call waiting state, judges the reception of the call signal transmitted from a pager service company (not shown). When the pager has sensed the reception of the call signal (step S71), the pager judges whether or not the call number of the call signal coincides with the its own call number stored in the ID-ROM 5 (step S72). Only when they coincide with each other, the pager causes the receiving section 3 to continue operation and temporarily stores in the RAM 23 the message data inputted soon after the call sense signal from the decoder section 4 (step S73).

Then, after the message based on the message data has been displayed on the LCD 15, the state of the area selection flag in the automatic setting flag area 211 is checked (step S74).

When it is confirmed that the area selection flag is set, it is judged whether or not a job code (format specification) is added to the head of the message data (step S75).

When a job code is added, it is judged whether or not there is an item code at the head of each piece of item information contained in the message data (step S76).

When an item code is present, the state of the data rearrangement flag in the automatic flag area 211 is checked (step S77).

If the data rearrangement flag in the automatic setting flag area 211 is set, the message data items are rearranged and stored in the job memory area corresponding to the job code in the message memory MA in the D-ROM 24, according to the priority set by the sensed item code, and then the call incoming process is completed (step S78).

In the above case, for instance, when

"*02*6*413:10*2TOKYO STATION*1AOKI YOUICHI"

is received as the message data, job code "*02" is sensed at the head of the message data. From the display format data memory FD in the D-ROM 24, the job content of the message data is judged to be "Meeting." Therefore, when a message is displayed on the basis of the message data, the display state as shown in FIG. 29 results.

In the display state, display portion "g" is where the item title and the item code have been set in the display format setting process. In the display format of FIG. 24, the incoming time "10:23" timed on a time stamp is displayed in the portion corresponding to item code "*6", message "13:10" in the portion corresponding to item code "*4", message "TOKYO STATION" in the portion corresponding to item code "*2", and message "AOKI YOUICHI" in the portion corresponding to item code "*1." Because the data rearrangement flag in the automatic setting flag area 211 is set, the message data is stored in the memory area for job content "Meeting" in the message memory area MA in the D-ROM 24. Because the priority item code is "*4", or kind of item "Time", the message is not stored in the memory area for "Meeting" in the order of incoming time, but in the order of meeting time, that is, the message is stored between "Message 3" received previously (meeting time is 13:00) and "Message 4" (Meeting time is 14:50). As a result of the storage, the address number identifying the order of messages is changed.

When at step S76, no item code is not sensed at the head of each piece of item information in the message data, it is impossible to identify the kinds of item of the item information in the message data. Accordingly, on the developed display screen, although the job message corresponding to the job code is displayed, a series of messages without item titles is displayed. Furthermore, the message data is stored in the job memory area corresponding to the job code in the message memory MA in the D-ROM 24. Because the absence of item codes makes it impossible to judge the priority by kinds of item, however, the message data is stored in the last address in the corresponding job memory area and the call incoming process is terminated (step S79).

At step S75, it is judged whether or not a job code is added to the head of the message data. If a code is not added, it is judged that there is no specification of display formats and a series of normal messages without message titles is displayed. Then, the message data is stored in the last address in the "Others" memory area in the message memory MA in the D-ROM 24, and the call incoming process is terminated (step S80).

When at step S74, it is found that the area selection flag in the automatic setting flag area 211 is reset, or at step S57, it is found that the data rearrangement flag in the automatic setting flag area 211 is reset, the message data is determined to be unprocessed data and is restored in the RAM 23 and the call incoming process is terminated (step S81).

Figure 30:
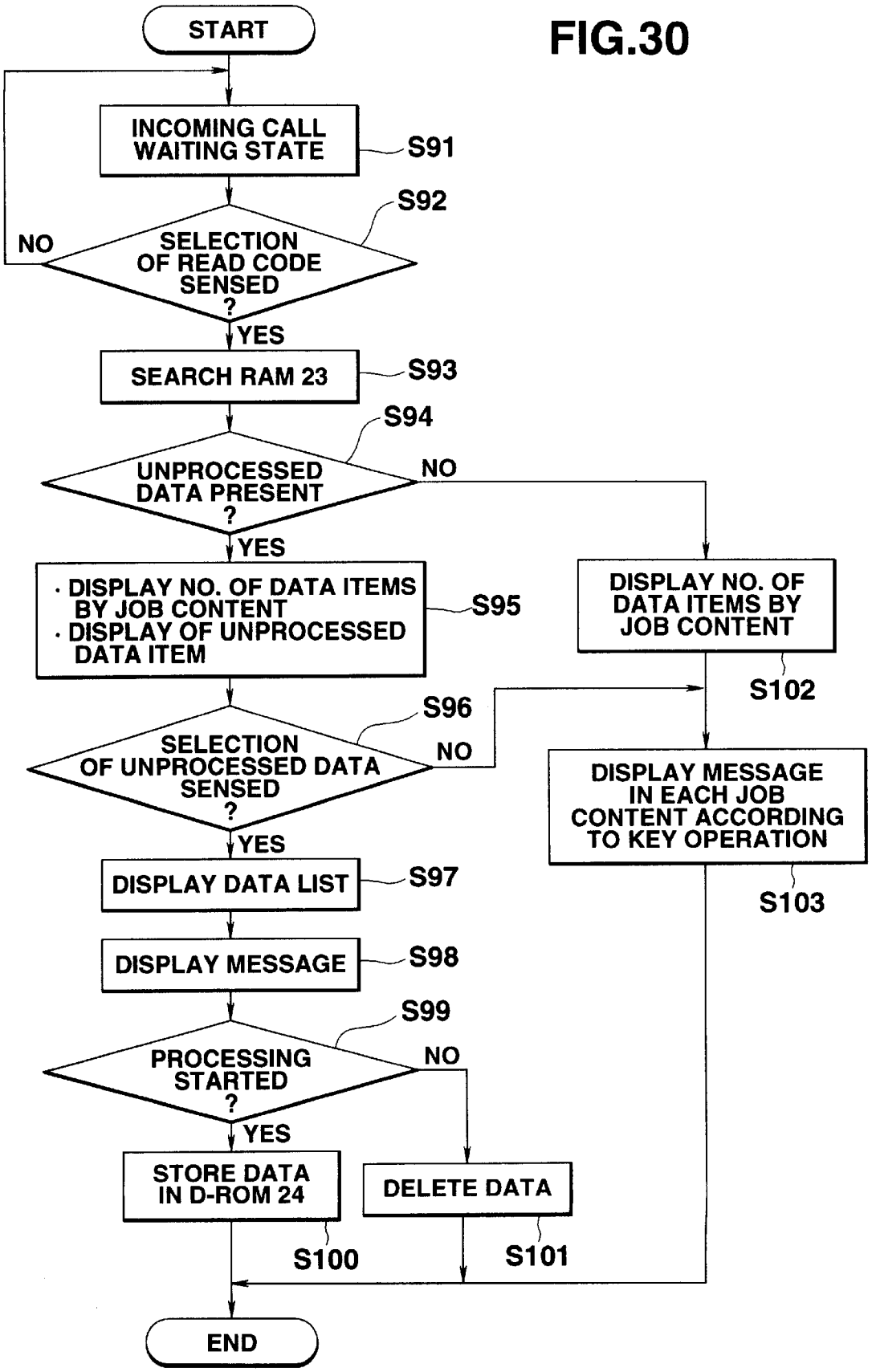
FIG. 30 is a view of a display example appearing on the LCD 15 of FIG. 9 on the basis of the message reading process executed by the pager according to the second embodiment.

Referring to the flowchart of FIG. 30 and the display examples shown in FIGS. 31 to 33, the processing of the message data in the read mode in the pager 20 of the second embodiment will be explained.

When the power switch is operated in the power-off state, the receiving section 3, under the control of the decoder section 4, effects intermittent driving to receive the frame information set to itself, that is, remains in the incoming call waiting state (step S91).

In this state, by a mode key operation at the key input section 25, it is judged whether or not the CPU 21 has sensed the selection of the read mode (step S92). If it has not sensed it, control will be passed to the incoming call waiting state at step S91.

If the selection of the message read mode has been sensed, the RAM 23 is searched for the memory (step S93) and it is judged whether or not unprocessed message data is stored (step S94).

Figure 31:
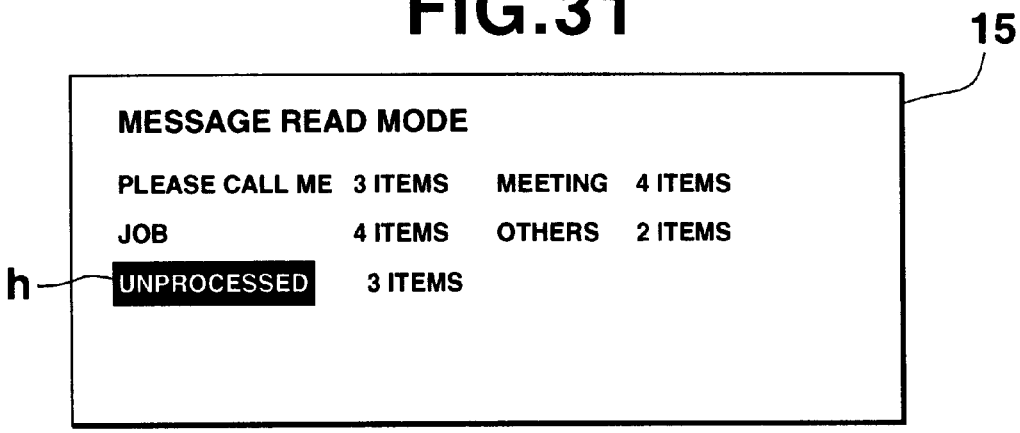
FIG. 31 is a view of a display example appearing on the LCD 15 of FIG. 9 on the basis of the message reading process executed by the pager according to the second embodiment.

When unprocessed data is present, a display screen as shown in FIG. 31 is developed. On the display screen, the number of items of the message data sorted out by job code and stored in the D-ROM 24 appears. If unprocessed data is present, the number of unprocessed data items will also be displayed in the display portion h (step S95).

In this display state, the selection and determination of portion "h" is judged (step S96).

Figure 32:
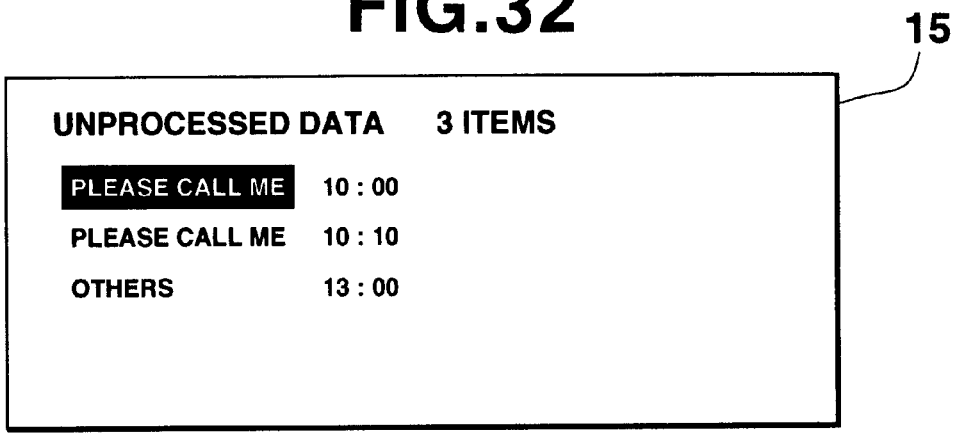
FIG. 32 is a view of a display example appearing on the LCD 15 of FIG. 9 on the basis of the message reading process executed by the pager according to the second embodiment.
Figure 33:
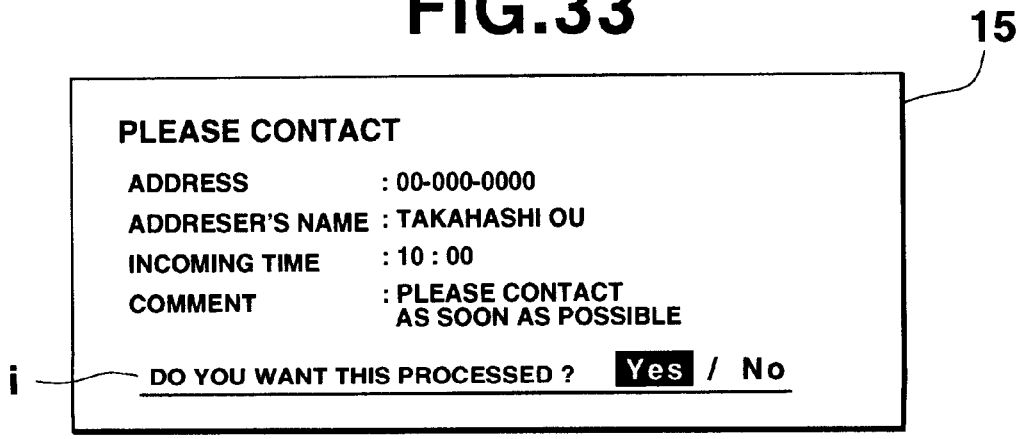
FIG. 33 is a view of a display example appearing on the LCD 15 of FIG. 9 on the basis of the message reading process executed by the pager according to the second embodiment.

When the selection and determination of portion "h" has been sensed, the display screen changes to that of FIG. 32, which shows the contents of the received message data and its incoming time at the same time (step S97).

In this display state, the message data to be displayed is specified by a select operation. When the determination of the message data has been sensed, the display screen as shown in FIG. 33 appears. Furthermore, in the lower portion of the screen, portion "i" is developed to prompt the user to choose whether to store the message into the D-ROM 24 (step S98).

In this display state, it is judged whether "Yes" or "No" in display portion "i" has been selected and determined (step S99).

When the determination of "Yes" has been sensed, the process of storing the unprocessed data into the D-ROM 24 is started. In the storing process, the data is automatically sorted out and stored according to the steps S75, S76, S78, S79, and S80 in that order in the flowchart of FIG. 25 (step S100).

When the determination of "No" has been sensed, the unprocessed data is judged to be unnecessary and deleted from the RAM 23 (step S101).

At step S94, when it is not judged whether or not the unprocessed message data is stored, the undisplayed contents in display portion "h" are developed on the LCD (step S102).

In this display state, the selection and determination are sensed and the incoming message is displayed (step S103). The end of the mode is judged by sensing the operation of the mode key.

When a message based on the incoming data is displayed, the message data can be simplified by making use of item codes.

Figure 29:
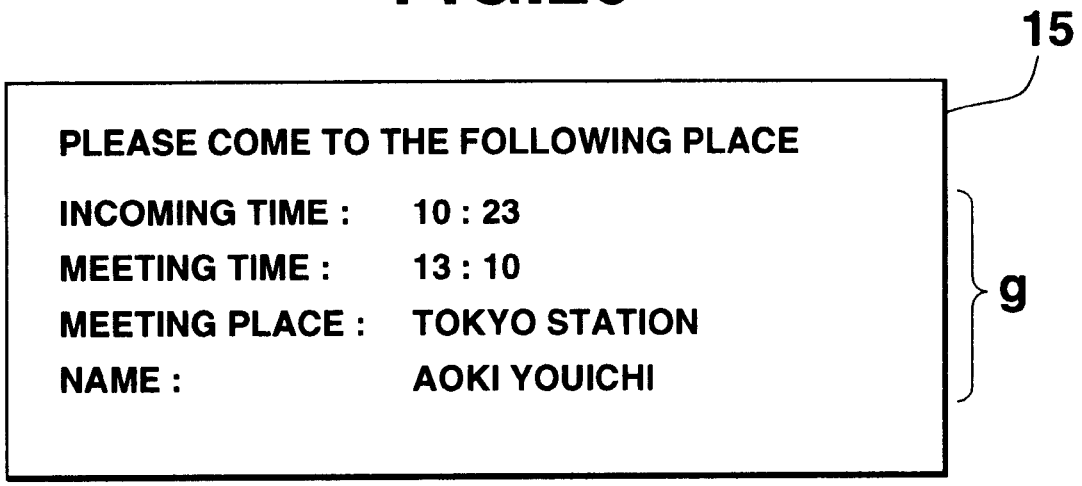
FIG. 29 is a view of a display example of the message appearing on the LCD 15 of FIG. 9 on the basis of the setting process executed by the pager according to the second embodiment.

Specifically, in the call incoming process, the display screen of FIG. 29 can be obtained even when, for example, the message data

"*02*6*413:10*2TOKYO STATION*1-*30987-65-4321"

is received, instead of receiving the message data

"*02*6*413:10*2TOKYO STATION*1AOKI YOUICHI"

In this case, the item code previously defined in the display format is connected to the item code specified by the data transmitter in the message data, which thereby specifies that the item information for the kinds of item set by the former item code should be retrieved from the TEL bank memory TB with reference to the item information for the kinds of item set by the latter item code and then displayed.

Therefore, in the case of the message data, item code "*1", or kind of item "Name" specifies that it should be retrieved from the TEL bank memory TB with reference to item code "*3", or kind of item "Telephone Number", "0987-65-4321" and the name, or "AOKI YOUICHI" be displayed.

Therefore, by performing such a message data process, the data transmitter side need not enter the character codes corresponding to character data items such as kana characters and alphabets and thereby can shorten and simplify the data.

Since in the display format, a display item and the corresponding item code are set in each line, the data transmitter does not necessarily create and transmit the item codes and item information in the order of line.

For instance, in creating data, the display contents of the message data based on the data are the same, even when the order of input is changed and "02*6*1AOKI YOUICHI*2TOKYO STATION*413:10" is inputted instead of "*02*6*413:10*2TOKYO STATION*1AOKI YOUICHI"

As described above, with the pager 20 of the present embodiment, the memory area in which the user stores the message data is designed to enable setting by job, the user can sort out and manage the message data.

Therefore, by applying the present invention to a pager with a large memory, it is possible to improve the managing function of incoming data and the use efficiency of the pager.

While in the first and second embodiments, the present invention has been applied to the pagers 1 and 20, it may be applied to portable communication terminals, teletext receivers, and digital radios. Specifically, the present invention may be applied to any device that can receive and store text information.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A receiving terminal comprising:

a receiver which receives data and which outputs the received data;

a display for displaying at least the received data;

a display format storage section tar storing (i) a display format including display contents to be displayed on said display together with the received data, and (ii) a format code specifying the display format, in such a manner that the display format and the format code correspond to each other;

a sensing section for sensing the format code from the received data; and a control section which performs a control operation whereby: (i) the display format corresponding to the format code sensed by said sensing section is read from said display format storage section, (ii) the display format is developed, (iii) the display contents and the received data are arranged on the display format, and (iv) the received data is then displayed on said display.

2. A receiving terminal according to claim 1, further comprising:

an item information sensing section for sensing item information from said received data; and wherein:

said display format storage section stores a display position of the item information in the display format; and said control section performs control so as to display the item information in the corresponding display position in the display format, when said item information sensing section senses the item information from the received data.

3. A receiving terminal according to claim 2, further comprising:

judging means for judging a kind of the item information; and wherein:

said display format storage section stores the display position by the kind of the item information; and said judging means, when said item information sensing section senses a plurality of pieces of item information, judges the kinds of these pieces of item information, and on the basis of a judgment result, said control section performs control so as to display these pieces of item information in the corresponding positions.

4. A receiving terminal according to claim 1, further comprising:

an item information sensing section for sensing item information from said received data; and wherein:

said display format storage section stores item titles set in the display format; and said control section, when said item information sensing section senses the item information from the received data, performs control so as to display the item information and the item title in the display format so that the item information and the item title correspond to each other.

5. A receiving terminal according to claim 4, further comprising:

judging means for judging a kind of the item information; and wherein:

said display format storage section stores item titles set by the kind of the item information and display format specify data items in such a manner that they correspond to each other; and said judging means, when said item information sensing section senses a plurality of pieces of item information, judges the kinds of these pieces of item information, and on the basis of a judgment result, said control section performs control so as to display these pieces of item information together with the corresponding item titles.

6. A receiving terminal according to claim 1, further comprising:

a storage section having a plurality of memory areas corresponding to the format codes; and a storage control section for sorting out the received data according to the format codes sensed at said sensing section and storing the sorted data in said storage section.

7. A receiving terminal according to claim 1, further comprising:

an entry specify data sensor for sensing entry specify data from the data received at said receiver; and wherein:

the format code and display format contained in the received data are entered in said display format storage section, when said entry specify data sensor senses entry specify data from the received data.

8. A receiving terminal according to claim 7, comprising an entry control means for overwriting the display format contained in the received data on the display format stored in said display format storage section so as to correspond to the format code therein, when the format code contained in the received data coincides with the format code stored in said display format storage section.

9. A receiving terminal according to claim 1, further comprising:

creating means for creating the display format; and entry control means for entering the display format created by said creating means into said display format storage section.

10. A receiving terminal according to claim 9, further comprising:

an item title storage section for storing a plurality of item titles set in the display format; and wherein:

said creating means creates a display format by selecting any of the item titles stored in said item title storage section.

11. A receiving terminal comprising:

a receiving circuit for receiving data, and for outputting the received data;

a display for displaying at least the received data;

a display format storage section for storing (i) a display format including display contents to be displayed on said display together with the received data, and (ii) a format code specifying the display format, in such a manner that the display format and the format code correspond to each other;

a sensing section for sensing the format code from the received data; and a CPU for: (i) reading the display format corresponding to the format code from said display format storage section, (ii) developing the display format, and (iii) arranging the display contents and the received data in accordance with the developed display format, when the format code is sensed by said sensing section, and (iv) then causing the received data to be displayed in the display format on said display.

12. A receiving terminal according to claim 11, further comprising:

a storage section having a plurality of memory areas corresponding to specify data items; and wherein said CPU sorts out the received data and stores the sorted data in said storage section according to the format code sensed from the received data.

13. A receiving terminal comprising:

a receiver which receives data and which outputs received data;

a display for displaying at least the received data;

a display format storage section for storing (i) a display format of data to be displayed on said display, and (ii) a format code specifying the display format, in such a manner that the display format and the format code correspond to each other;

a sensing section for sensing the format code from the received data;

a control section which performs a control operation whereby: (i) the display format corresponding to the format code sensed by said sensing section is read from said display format storage section, (ii) the display format is developed, (iii) the received data is arranged on the display format, and (iv) the received data is then displayed on said display;

an item information sensing section for sensing item information from said received data; and judging means for judging the item information;

wherein said display format storage section stores a corresponding display position of the item information in the display format; and wherein said control section performs control so as to display the item information in the corresponding display position in the display format when said item information sensing section senses the item information from the received data and said display format storage section stores the display position in accordance with a judgment result of the judging means with respect to the item information; and wherein said judging means, when said item information sensing section senses a plurality of pieces of item information, judges each of the plurality of pieces of item information, and said control section performs control so as to display the plurality of pieces of item information in corresponding positions in accordance with a judgment result of the judging means with respect to the plurality of pieces of item information.

14. A receiving terminal comprising:

a receiver which receives data and which outputs received data;

a display for displaying at least the received data;

a display format storage section for storing (i) a display format of data to be displayed on said display, and (ii) a format code specifying the display format, in such a manner that the display format and the format code correspond to each other;

a sensing section for sensing the format code from the received data;

a control section which performs a control operation whereby: (i) the display format corresponding to the format code sensed by said sensing section is read from said display format storage section, (ii) the display format is developed, (iii) the received data is arranged on the display format, and (iv) the received data is then displayed on said display; and an item information sensing section stores item information from said received data;

wherein said display format storage section stores item titles set in the display format; and wherein said control section, when said item information sensing section senses the item information from the received data, performs control so as to display the item information and the item title in the display format so that the item information and the item title correspond to each other.

15. A receiving terminal comprising:

a receiver which receives data and which outputs received data;

a display for displaying at least the received data;

a display format storage section for storing (i) a display format including display contents to be displayed on said display together with the received data, and (ii) a format code specifying the display format, in such a manner that the display format and the format code correspond to each other;

a sensing section for sensing the format code from the received data;

a control section which performs a control operation whereby: (i) the display format corresponding to the format code sensed by said sensing section is read from said display format storage section, (ii) the display format is developed, (iii) the display contents and the received data are arranged on the display format, and (iv) the received data is then displayed on said display; and an entry specify data sensor for sensing entry specify data from the data received at said receiver;

wherein the format code and display format contained in the received data are entered in said display format storage section when said entry specify data sensor senses entry specify data from the received data.

16. A receiving terminal comprising:

a receiver which receives data and which outputs received data;

a display for displaying at least the received data;

a display format storage section for storing (i) a display format including display contents to be displayed on said display together with the received data, and (ii) a format code specifying the display format, in such a manner that the display format and the format code correspond to each other;

a sensing section for sensing the format code from the received data;

a control section which performs a control operation whereby: (i) the display format corresponding to the format code sensed by said sensing section is read from said display format storage section, (ii) the display format is developed, (iii) the display contents and the received data are arranged on the display format, and (iv) the received data is then displayed on said display;

creating means for creating the display format; and entry control means for entering the display format created by said creating means into said display format storage section.

17. A receiving terminal comprising:

a receiver which receives a plurality of display data including a plurality of display items;

a first storage section which stores the plurality of display data received by the receiver;

a second storage section which stores at least one specific item included in the display data and a display priority order in which the plurality of the display data stored in said first storage section are displayed, in correspondence with each other;

a sensing section which senses the specific item from the display data; and a control section which reads out the display priority order corresponding to the specific item from said second storage section, and controls stored contents of the first storage section so as to display the display data in accordance with the display priority order when the sensing section senses the specific item.

18. A receiving terminal according to claim 17, further comprising:

a selector unit which selects the specific item from among the plurality of display items;

a setting section which sets the display priority order for the display data in correspondence with the specific item selected by the selector unit; and a second storage control section which stores the contents set by the setting section into the second storage section.

19. A receiving terminal according to claim 17, further comprising a third storage section, and the first storage control section sorts the plurality of display data stored in the first storage section in accordance with the display priority data and stores them in the third storage section.

* * * * *